US009166305B2

(12) United States Patent
Hashimoto et al.

(10) Patent No.: US 9,166,305 B2
(45) Date of Patent: Oct. 20, 2015

(54) COAXIAL ELECTRIC CONNECTOR

(71) Applicant: DAI-ICHI SEIKO CO. LTD., Kyoto-shi (JP)

(72) Inventors: Yoichi Hashimoto, Fukuoka (JP); Hiroyuki Kon, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/453,051

(22) Filed: Aug. 6, 2014

(65) Prior Publication Data

US 2015/0044912 A1 Feb. 12, 2015

(30) Foreign Application Priority Data

Aug. 8, 2013 (JP) ..... 2013-164727

(51) Int. Cl.
*H01R 9/05* (2006.01)

(52) U.S. Cl.
CPC ..... *H01R 9/0518* (2013.01); *H01R 2201/16* (2013.01)

(58) Field of Classification Search
CPC ..... H01R 17/12; H01R 133/53
USPC ..... 439/578, 585, 668–669, 79, 63, 934, 439/388
See application file for complete search history.

(56) References Cited

U.S. PATENT DOCUMENTS

| | | | | |
|---|---|---|---|---|
| 5,380,211 | A * | 1/1995 | Kawaguchi et al. | 439/74 |
| D674,346 | S * | 1/2013 | Hashimoto | D13/133 |
| 2006/0024985 | A1* | 2/2006 | Nagata et al. | 439/63 |
| 2013/0102173 | A1* | 4/2013 | Hashimoto et al. | 439/188 |

FOREIGN PATENT DOCUMENTS

| | | |
|---|---|---|
| JP | 2002-324636 | 11/2002 |
| JP | 2005-183214 | 7/2005 |
| JP | 2011-40262 | 2/2011 |

* cited by examiner

*Primary Examiner* — Phuongchi T Nguyen
(74) *Attorney, Agent, or Firm* — Oblon, McClelland, Maier & Neustadt, L.L.P.

(57) ABSTRACT

Good signal transmission characteristics can be stably obtained by a simple structure. A pressure-contact surface of a cover inner surface of a shell cover part 13*b*, which is openably/closably coupled to a cylindrical opening of an external conductor shell 13*a*, and an insulative pressing plate 11*d* is provided with a void part 14, which separates at least one of them from the other one. By virtue of this, it is configured that the characteristic impedance about the cable-shaped signal transmission medium SC can be adjusted by the void part 14, and the matching degree (VSWR) of the characteristic impedance with respect to transmission signals can be easily and appropriately matched.

6 Claims, 29 Drawing Sheets

COAXIAL ELECTRIC CONNECTOR

BACKGROUND OF THE INVENTION

1. Field of the Invention

The present invention relates to a coaxial electric connector coupled to a cable-shaped signal transmission medium such as a thin coaxial cable.

2. Description of Related Art

Generally, as a signal transmission medium of various electronic devices or electric devices such as mobile phones, a cable-shaped signal transmission medium such as a thin coaxial cable has been employed, and a coaxial electric connector for efficiently connecting the cable-shaped signal transmission medium to a printed wiring board has been known. For example, in a coaxial electric connector described in Patent Literature 1 described below, an external conductor shell consisting of an approximately hollow tubular member is attached to the outer peripheral side of an insulating housing, and a shell cover part is openably/closably coupled to a cylindrical opening of the external conductor shell. The shell cover part, which has been in an open state when a terminal part of the cable-shaped signal transmission medium is coupled, is closed so as to be pushed down together with an electrically-conductive contact, the electrically-conductive contact is bent and sandwiches the cable-shaped transmission medium, thereby establishing electrical connection.

According to the coaxial electric connector having such a structure, a solder connection operation for connecting the electrically-conductive contact and a coaxial cable is omitted. Therefore, assembly workability is improved, problems from environmental viewpoints caused by, for example, disposal of solder materials are solved, and an advantage that a gap in characteristic impedance caused by the difference in the amount of used solder is eliminated is also obtained.

However, in the conventional coaxial electric connectors, particularly as recent increase in the frequency of transmission signals and rapid downsizing or height reduction of electric connectors are advanced, there is a tendency that the matching degree (VSWR) of the characteristic impedance with respect to the transmission signals becomes a non-matched sate, and it is becoming difficult to maintain good high-frequency characteristics.

The inventors of the present application discloses below Patent Literature as a conventional technique of the invention of the present application.

[Patent Literature 1] Japanese Patent Application Laid-Open No. 2011-40262

BRIEF SUMMARY OF THE INVENTION

Therefore, it is an object of the present invention to provide a coaxial electric connector with which good signal transmission characteristics can be stably obtained by a simple structure.

In order to achieve the above described object, in the present invention, an electric connector having an insulating housing coupled to a terminal part of a cable-shaped signal transmission medium; an external conductor shell consisting of an approximately hollow cylindrical member attached so as to cover part of an external surface of the insulating housing, and an internal conductor contact attached to an inner region of the insulating housing; wherein a shell cover part for opening/closing a cylindrical opening of the external conductor shell is openably/closably coupled to the cylindrical opening of the external conductor shell; in the insulating housing, an insulative pressing plate, which is integrally opened/closed with the shell cover part, is provided so as to be extended along a cover inner surface of the shell cover part; and a predetermined region of the cover inner surface of the shell cover part is configured to be disposed so as to be opposed to the insulative pressing plate when the shell cover part is closed so as to cover the cylindrical opening of the external conductor shell; the electrical connector is configured to be provided with a void part in a region in which the cover inner surface of the shell cover part and the insulative pressing plate are opposed to each other, the void part formed by separating at least one of the cover inner surface of the shell cover part and the insulative pressing plate from the other.

According to the present invention having such a structure, the dielectric constant thereof is reduced by the degree that the void part is provided, and the electrostatic capacity thereof is reduced. Therefore, the characteristic impedance about the cable-shaped signal transmission medium is adjusted by the void part, and the matching degree (VSWR) of the characteristic impedance with respect to transmission signals is easily and appropriately matched. As a result, transmission of high-frequency signals is carried out well.

Moreover, in the present invention, it is desired that the void part be formed by a recessed groove formed on at least one of the cover inner surface of the shell cover part and the insulative pressing plate so as to be extended along the cable-shaped signal transmission medium.

When such a structure is employed, the void part which adjusts the characteristic impedance with respect to the cable-shaped signal transmission medium is easily and reliably formed.

Furthermore, in the present invention, it is desired that, in a partial region of a periphery of the void part consisting of the recessed groove, a drop preventing part for regulating drop of the insulative pressing plate into the void part be provided.

When such a structure is employed, the cover inner surface and the insulative pressing plate are maintained in a good separated state by the drop preventing part. Therefore, the void part is reliably formed.

On the other hand, in the present invention, the cable-shaped signal transmission medium is formed by a coaxial cable having a cable center conductor connected to the internal conductor contact and a cable shield conductor disposed in an outer peripheral side of the cable center conductor via a dielectric body; and the internal conductor contact is provided with at least a cable placing part on which the cable center conductor of the cable-shaped signal transmission medium is placed and a tongue-shaped part extended from a part coupled to the cable placing part and pushed against the insulative pressing plate.

In this case, it is desired that the void part consisting of the recessed groove be formed so as to be extended along the cable-shaped signal transmission medium from the coupled part of the cable placing part and the tongue-shaped part of the internal conductor contact to an exposed part of the dielectric body of the cable-shaped signal transmission medium.

When such a structure is employed, the characteristic impedance of the region in which the cable-shaped signal transmission medium is electrically connected is reliably adjusted.

Furthermore, it is desired that the void part consisting of the recessed groove in the present invention be formed by reducing the thickness of the shell cover part.

According to such a structure, even when the void part is provided, the thickness of the shell cover part is not increased. Therefore, the void part does not become an obstacle of height reduction of the connector.

As described above, the present invention provides the void part in the opposed region of the cover inner surface of the shell cover part, which is openably/closably coupled to the cylindrical opening of the external conductor shell, and the insulative pressing plate by separating at least one of the cover inner surface of the shell cover part and the insulative pressing plate from the other one to reduce the dielectric constant and reduce the electrostatic capacity. By virtue of this, the characteristic impedance about the cable-shaped signal transmission medium can be adjusted by the void part, and the matching degree (VSWR) of the characteristic impedance with respect to transmission signals is configured to be easily and appropriately matched. Therefore, good signal transmission characteristics can be stably obtained by a simple structure, and the reliability of the electric connector can be significantly improved at low cost.

DETAILED DESCRIPTION OF THE INVENTION

Figure 1:
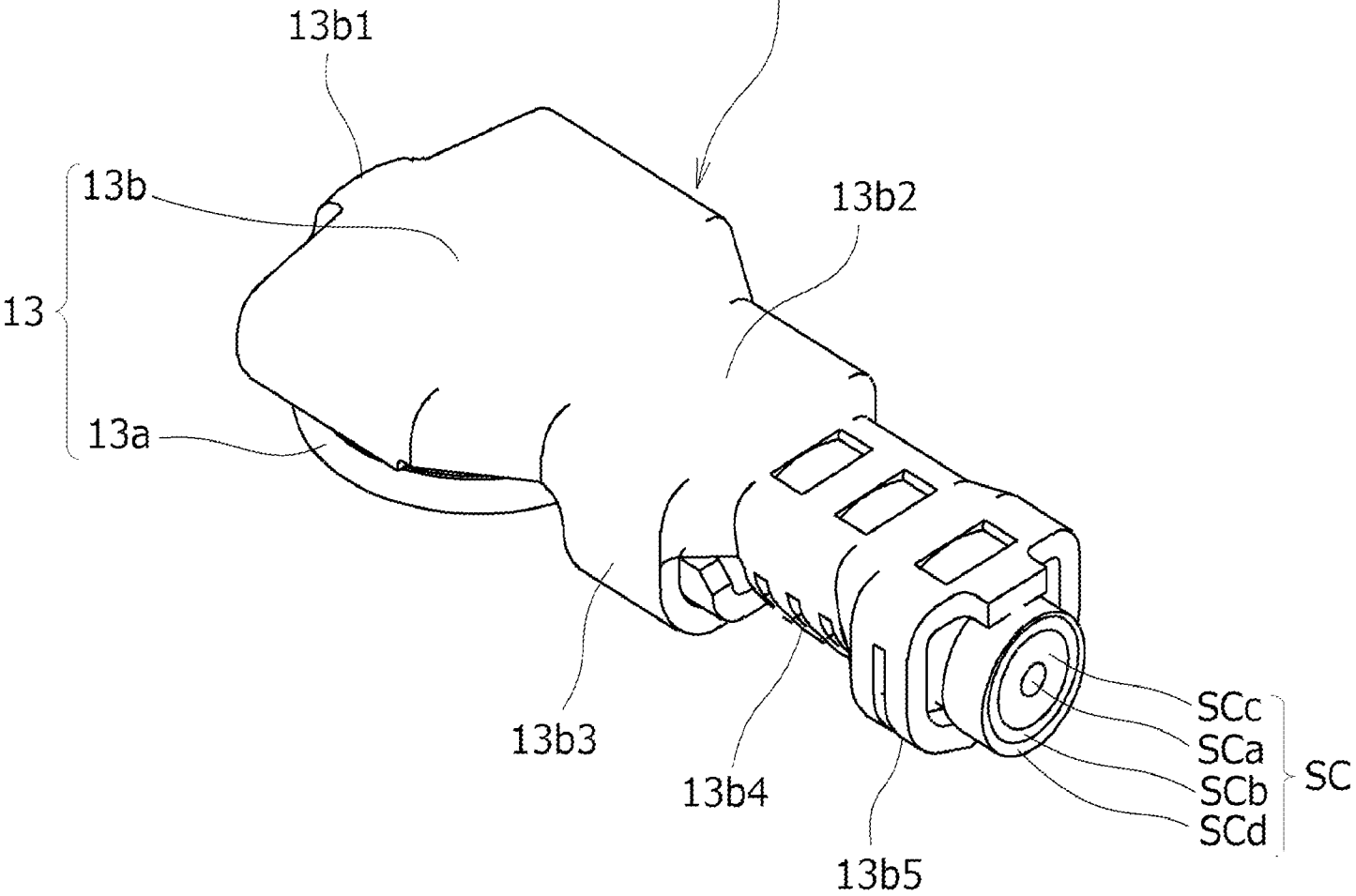
FIG. 1 is an external-appearance explanatory perspective view showing, from a front side, a single coaxial electric connector (plug connector) coupled to a coaxial cable according to a first embodiment of the present invention.
Figure 2:
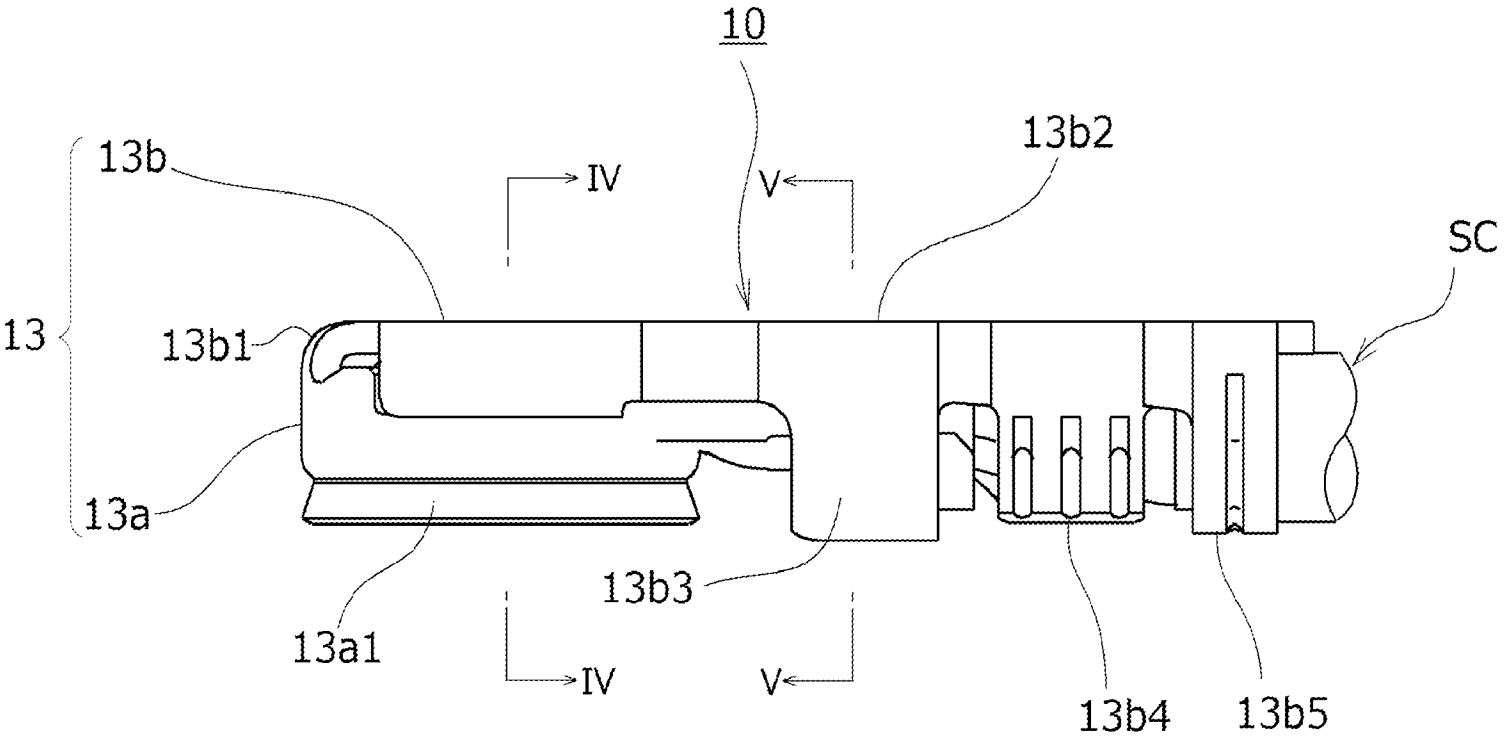
FIG. 2 is an external-appearance explanatory perspective view showing, from a lateral side, the single plug connector shown in FIG. 1.
Figure 3:
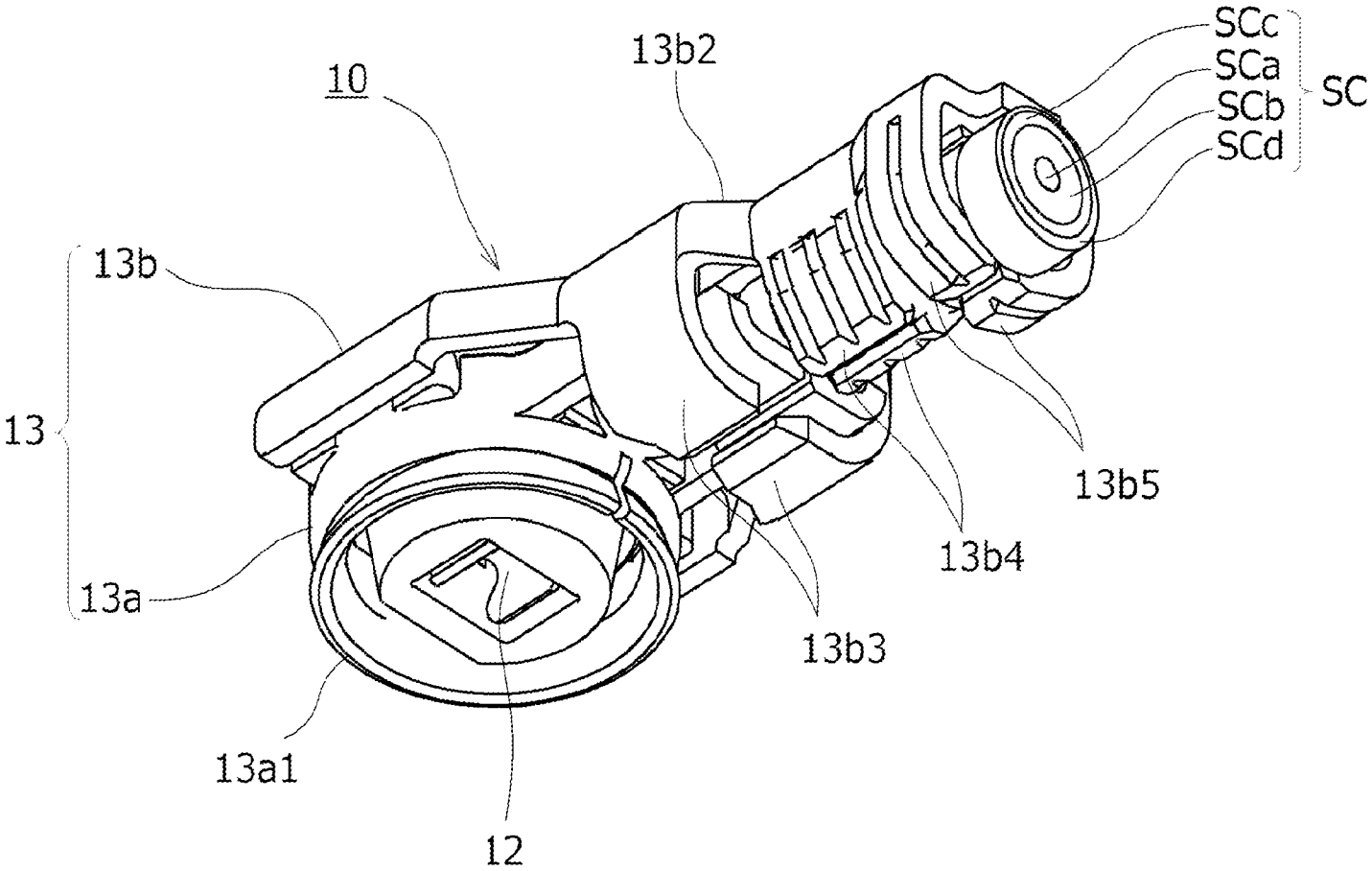
FIG. 3 is a bottom-surface explanatory view of the single plug connector shown in FIG. 1 and FIG. 2.

Hereinafter, embodiments in which the present invention is applied to a coaxial electric connector using a thin coaxial cable as a signal transmission medium will be described in detail based on drawings.

[About Overall Structure of Coaxial Electric Connector]

First, a plug connector 10 serving as a coaxial electric connector according to a first embodiment of the present invention shown in FIG. 1 to FIG. 6 is configured to be coupled to a terminal part of a thin coaxial cable SC serving as a cable-shaped signal transmission medium and is configured to be mated so as to be inserted from the upper side to or removed from a mating electric connector (illustration omitted) consisting of, for example, a receptacle connector mounted on a predetermined printed wiring board, of which illustration is omitted. A mating/removing operation of the plug connector 10 with respect to the mating electric connector (for example, receptacle connector) is carried out in a direction approximately orthogonal to the plane of the printed wiring board.

More specifically, a connector main-body part constituting a main mating part of the plug connector 10 is formed so as to form a cylindrical shape as a rough shape, a terminal part of the thin coaxial cable SC is coupled to the connector main-body part of the connector 10, which forms the approximately cylindrical shape, from one direction in a radial-direction outer side, and, in a state in which the thin coaxial cable SC is coupled, the plug connector 10 is disposed so as to face a position above the mating electric connector (for example, receptacle connector). Then, when the entirety of the plug connector 10 is moved down in a direction approximately orthogonal to the outer surface of the printed wiring board, a lower end part of the plug connector 10 is brought into a mated state with an upper end part of the mating electric connector. When the plug connector 10 is brought into the mated state in which the plug connector 10 is inserted from the upper side to the mating electric connector in this manner, the terminal part of the thin coaxial cable SC is connected to a wiring-pattern electrically-conductive path on the printed wiring board via the plug connector 10 and the mating electric connector.

Herein, the direction in which the plug connector 10 is inserted to the mating electric connector (for example, receptacle connector) is "downward direction", and the removing direction of removing in the opposite direction thereof is "upward direction". Also, in the plug connector 10 per se, an edge part to which the end part of the thin coaxial cable SC is connected is "front-side edge part", an edge part in the opposite side thereof is "back-side edge part", furthermore, the direction from the "back-side edge part" toward the "front-side edge part" is "connector forward direction", and the reverse direction thereof is "connector backward direction". Also, a direction orthogonal to both of "connector top-bottom direction" and "connector front-back direction" is "connector left-right direction".

[About Coaxial Cable]

Figure 7:
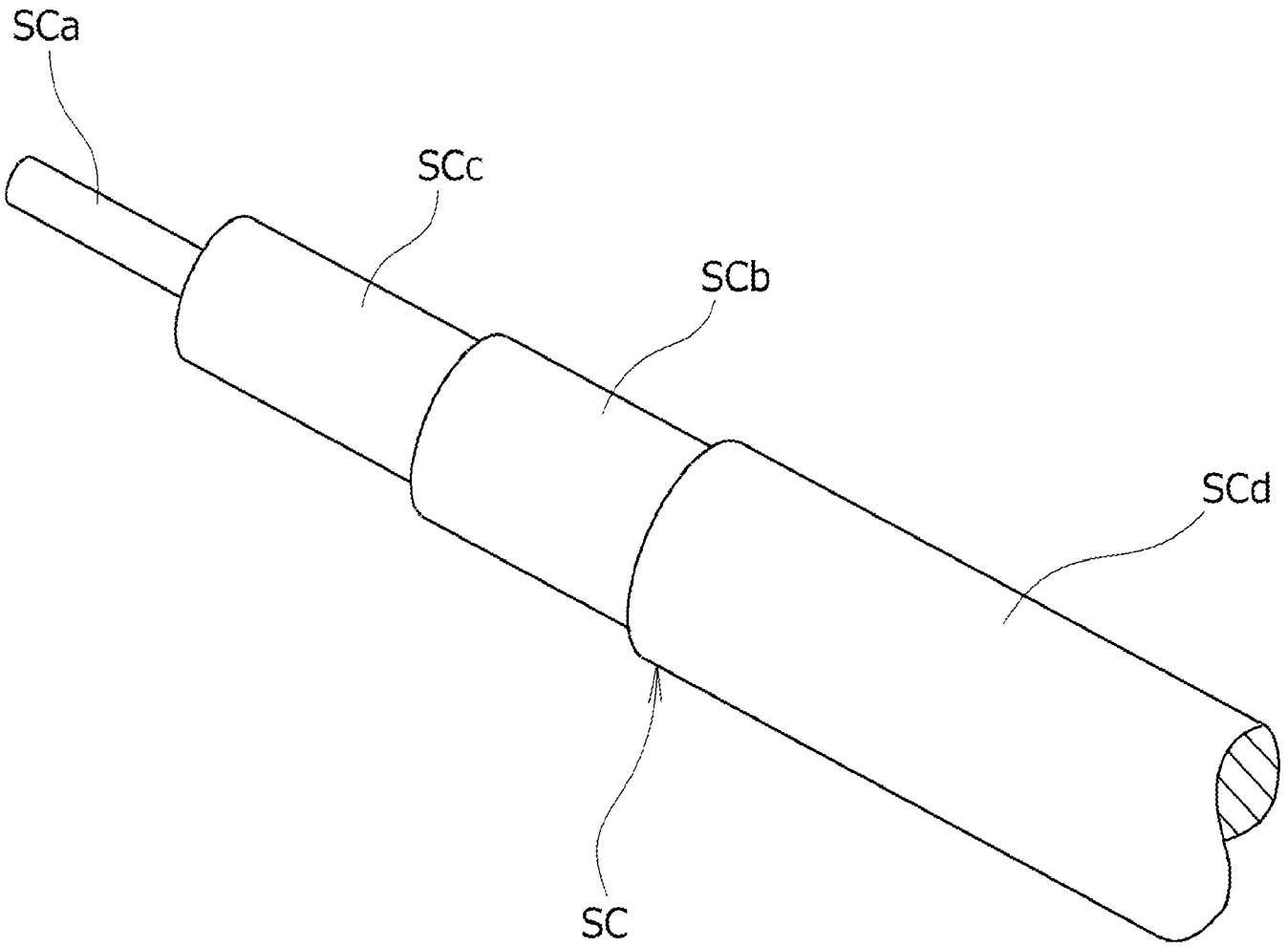
FIG. 7 is an external-appearance explanatory perspective view showing a single thin coaxial cable serving as a signal transmission medium, which is coupled to the coaxial electric connector (plug connector) according to the first embodiment of the present invention.

Particularly as shown in FIG. 7, the thin coaxial cable SC serving as the cable-shaped signal transmission medium has a structure in which a cable center conductor (signal line) SCa formed of a plurality of conductive wires and a cable shield conductor (shield line) SCb are coaxially stacked via a cable dielectric body SCc. Among them, the cable shield conductor (shield line) SCb is brought into an exposed state by peeling off an outer-periphery coating material SCd, and the cable center conductor (signal line) SCa is brought into exposed state by further peeling off the cable shield conductor (shield line) SCb and the cable dielectric body SCc.

The cable center conductor SCa disposed so as to be along a central axis of the thin coaxial cable SC is connected to an internal conductor contact (signal electrically-conductive contact) 12 attached to an insulating housing 11, thereby constituting a signal circuit. Moreover, the cable shield conductor SCb disposed so as to surround the outer peripheral side of the cable center conductor SCa is connected to a shield shell 13, and the shield shell 13 functions as a ground electrically-conductive contact for earth connection, thereby constituting a ground circuit.

[About Insulating Housing]

Herein, the above described insulating housing 11 has an approximately-disk-shaped insulating main-body part 11*a* constituting the connector main-body part, which is a main mating part, and, in a part below the insulating main-body part 11*a*, integrally has an insulating insertion part 11*b*, which is inserted in the inner side of the electric connector (for example, receptacle connector), which is a mating counterpart. At an approximately center part of the insulating main-body part 11*a* among them, the terminal part of the above described thin coaxial cable SC is set so as to be placed thereon, and the internal electrically-conductive contact (signal electrically-conductive contact) 12 on which the cable center conductor (signal line) SCa of the thin coaxial cable SC is placed is attached to a part formed in a recessed shape at an approximately center part of the upper surface of the insulating main-body part 11*a*.

The shield shell 13 serving as a ground contact is attached to the above described insulating main-body part 11*a* so as to surround the periphery of the above described internal electrically-conductive contact 12 from the outer side. Furthermore, a cable supporting part 11*c* formed by a recessed groove forming an approximately semicircular shape in a front view (see FIG. 5) is formed at the front-side edge part of the insulating main-body part 11*a*, and the terminal part of the above described thin coaxial cable SC is configured to be placed on and received by an inner-side wall surface of the cable supporting part 11*c*.

Figure 8:
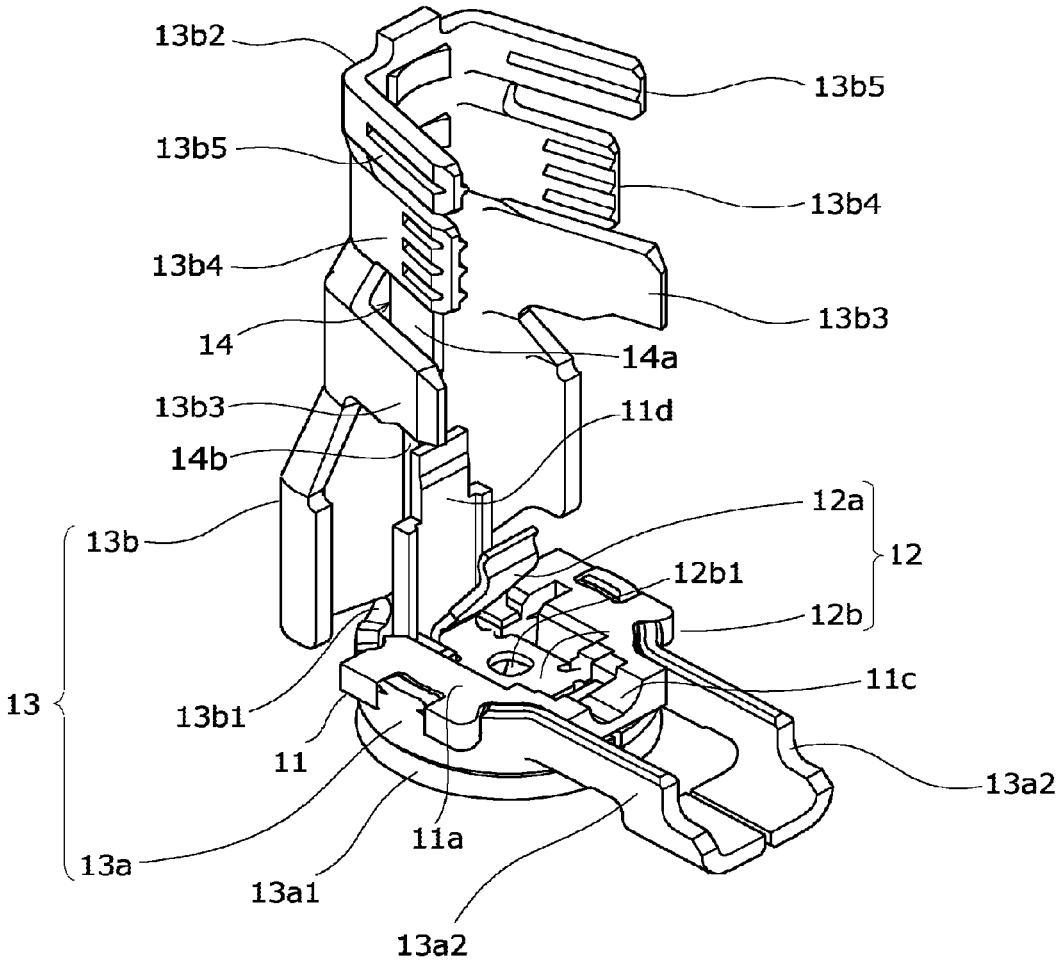
FIG. 8 is an external-appearance explanatory perspective view showing an initial open state (cable uncoupled state) of the coaxial electric connector (plug connector) according to the first embodiment of the present invention.

Furthermore, the insulating main-body part 11*a* of the above described insulating housing 11 is integrally provided with an insulative pressing plate 11*d* consisting of a tongue-shaped member so as to cover the cable center conductor SCa of the thin coaxial cable SC from the upper side. The insulative pressing plate 11*d* is formed of a thin long plate-like member which projects to form a cantilever shape from the connector-rear-end-side edge of the insulating main-body part 11*a* so as to be along the thin coaxial cable SC. Particularly, in an initial state as shown in FIG. 8 before the terminal part of the thin coaxial cable SC is placed thereon, the insulative pressing plate 11*d* is raised upward and brought into an open state. Then, the insulative pressing plate 11*d* is configured to be bent downward together with a later-described shell cover part 13*b* and disposed along the upper side of the thin coaxial cable SC after the terminal part of the thin coaxial cable SC is set at the insulating housing 11.

With respect to the insulating main-body part 11*a* of the insulating housing 11 constituting such a main mating part, the insulating insertion part 11*b* is configured to integrally project downward from the insulating main-body part 11*a* as described above, and the insulating insertion part 11*b* is formed so as to have an approximately hollow cylindrical shape. The insulating insertion part 11*b* is configured to be inserted from the lower end side thereof toward the inner side of the mating electrical connector (for example, receptacle connector), which is the mating counterpart, as described above.

[About Shield Shell]

Figure 4:
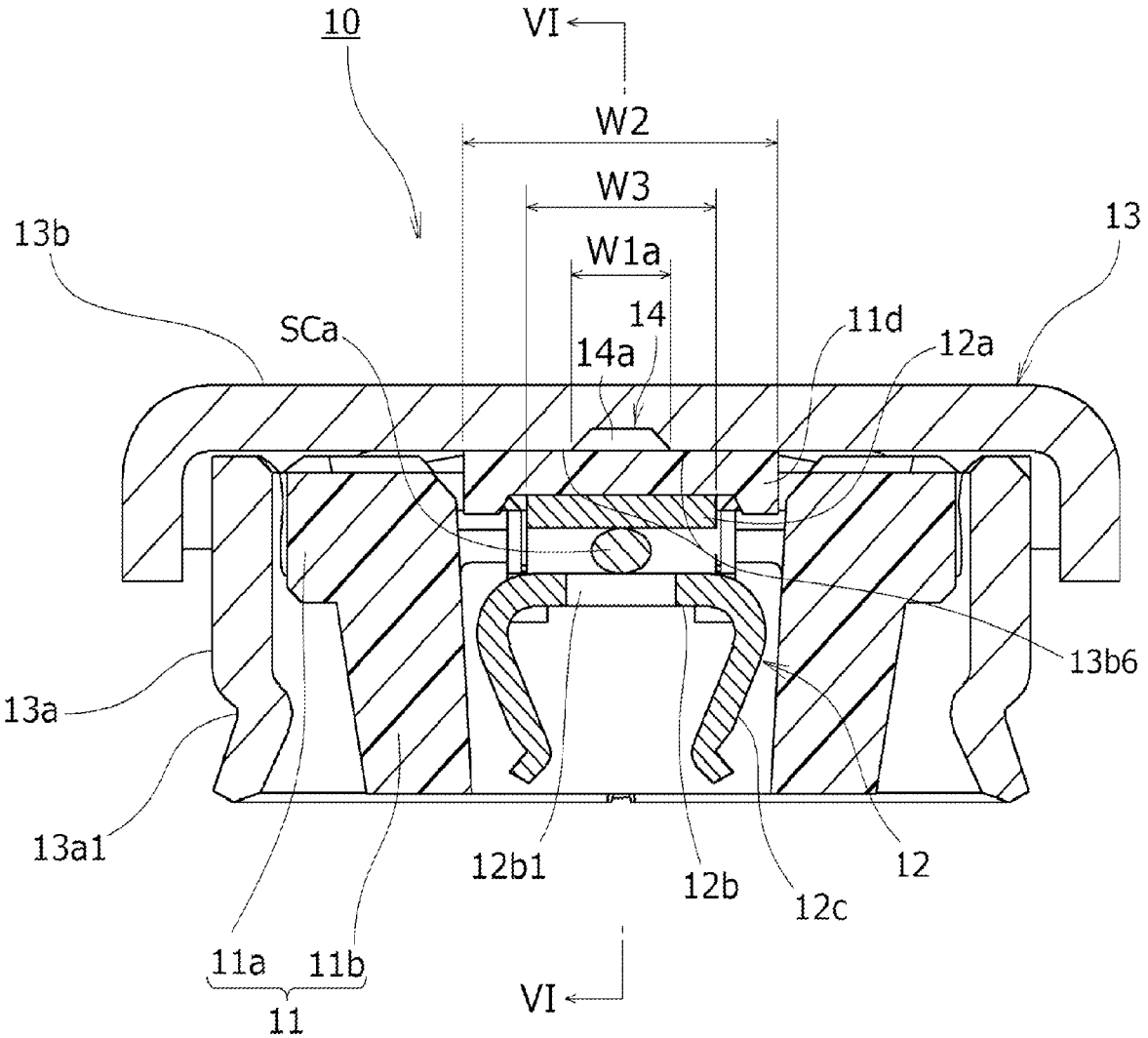
FIG. 4 is a transverse cross-sectional explanatory view along a line IV-IV in FIG. 2.
Figure 5:
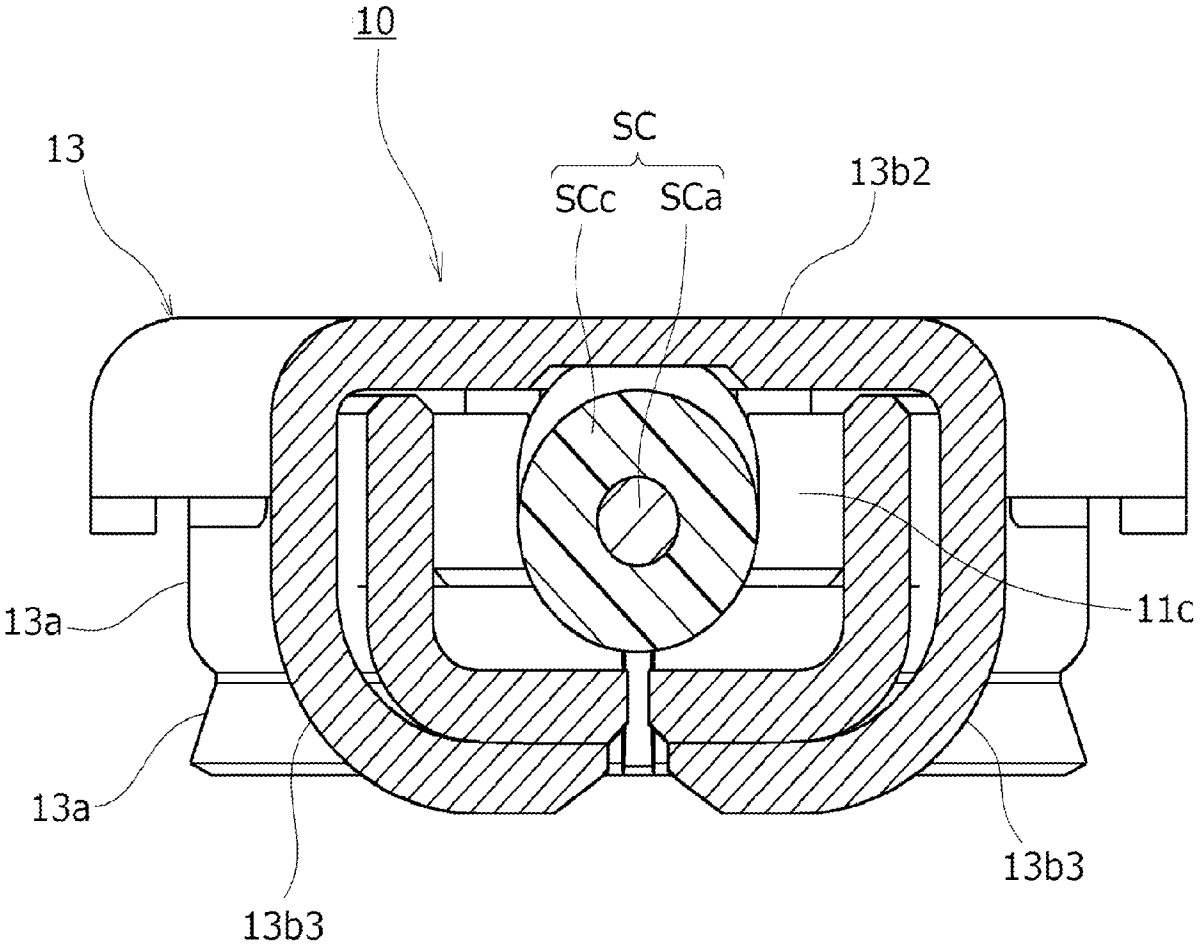
FIG. 5 is a transverse cross-sectional explanatory view along a line V-V in FIG. 2.

Furthermore, as shown in FIG. 4 and FIG. 8, the outer surface of the insulating housing 11 having the insulating main-body part 11*a* and the insulating insulation part 11*b* described above is covered with an external conductor shell 13*a* constituting a main mating part of the shield shell 13 consisting of a thin plate-shaped metal member. The external conductor shell 13*a* is formed in an approximately hollow cylindrical shape, which is formed so as to annularly cover mainly the insulating main-body part 11*a* of the insulating housing 11 from the radial-direction outer side. A lower part of the external conductor shell 13*a* is a shell insertion part 13*a*1, which annularly covers the above described insulating insertion part 11*b* from the radial-direction outer side, and the shell cover part 13*b* covering the upper surface side of the above described insulating main-body part 11*a* is openably/closably coupled to an upper-end-side cylindrical open part of the external conductor shell 13*a*.

Herein, particularly as shown in FIG. 8 to FIG. 12, the shield shell 13 in the initial state before the terminal part of the thin coaxial cable SC is connected and fixed, the shell cover part 13*b* is brought into a state in which it is open to the upper side with respect to the above described external conductor shell 13*a*. More specifically, the shell cover part 13*b* in the initial state is disposed so as to rise approximately vertically upward via a joining member 13*b*1 consisting of a narrow plate-shaped member at a rear-side edge part of the external conductor shell 13*a*. At the cover inner surface of the shell cover part 13*b*, in other words, the surface positioned in the inner side when the shell cover part 13*b* is closed, the insulative pressing plate 11*d* consisting of the tongue-shaped member rising upward from the insulating main-body part 11*a* of the insulating housing 11 is disposed so as to be along the cover inner surface of the shell cover part 13*b*. Note that the set position(s) and the set number of the joining member(s) 13*b* 1 can be arbitrarily selected.

Then, after the terminal part of the thin coaxial cable SC is placed on and set so as to be received by the cable supporting part 11*c* of the insulating housing 11 in the open state (initial state) of the shield shell 13 described above, when the shell cover part 13*b* of the shield shell 13 is pushed down to an approximately horizontal state so that the joining member 13*b*1 is bent approximately at a right angle toward the lower side together with the insulative pressing plate 11*d*, the entirety of the insulating main-body part 11*a* of the insulating housing 11 is covered with the shell cover part 13*b* from the upper side as a result, and the shield shell 13 is brought into a closed state.

The shell cover part 13*b* at this point has a covering structure so that, when the shell cover part 13*b* is pushed down to the approximately horizontal state and closed in the above described manner, a cylindrical open part in the upper end side of the external conductor shell 13*a* is covered. A front cover part 13*b*2, which particularly covers the cable dielectric body SCc and the cable shield conductor (shield line) SCb of the thin coaxial cable SC from the upper side, is integrally continued to a front part of the shell cover part 13*b*, which is pushed down to the approximately horizontal state. The front cover part 13*b*2 is configured to cover the thin coaxial cable SC and also a pair of cable protecting arms 13*a*2 and 13*a*2, which are projecting from the above described external conductor shell 13*a* to the front side, from the outer side.

The cable protecting arms 13*a*2 and 13*a*2 at this point is configured to be extended along left-right-direction both sides sandwiching the thin coaxial cable SC, and the cable protecting arms of the pair are provided so as to project to the front side so as to be opposed to each other approximately in parallel from the front-side edge part of the above described external conductor shell 13*a* along the terminal part of the thin coaxial cable SC.

In both-side edge parts of the front cover part 13*b*2 provided so as to project from the front side of the shell cover part 13*b* in the above described manner, first fixing/retaining plates 13*b*3 consisting of a pair of tongue-shaped members, second fixing/retaining plates 13*b*4, and third fixing/retaining plates 13*b*5 are provided so as to form flange-plate shapes. The first fixing/retaining plates 13*b*3 among them are configured to be bent and swage-fixed so as to cover the thin coaxial cable SC and the cable protecting arms 13*a*2 and 13*a*2 from the outer side.

More specifically, the both-side flange plates constituting the pair of first fixing/retaining plates 13*b*3 and 13*b*3 are disposed so as to be positioned both-side outer sides of the cable protecting arms 13*a*2 and 13*a*2 when the shell cover part 13*b* is pushed down to the approximately horizontal state and, in this state, are bend to the connector inner side along both-side outer wall surfaces of the cable protecting arms 13*a*2 and 13*a*2 so as to carry out swaging. As a result, the shell cover part 13*b* is fixed to the external conductor shell 13*a*, and, particularly, the cable dielectric body SCc of the thin coaxial cable SC is configured to be fixed to the shell cover part 13*b*.

Furthermore, the second fixing/retaining plates 13*b*4 and the third fixing/retaining plates 13*b*5 are provided so as to be adjacent and juxtaposed to each other in the front side of the above described first fixing/retaining plates 13*b*3 and are formed of comparatively small flange plates. The second fixing/retaining plates 13*b*4 and the third fixing/retaining plates 13*b*5 are configured to be bent and swage-fixed so as to cover the cable shield conductor (shield line) SCb and the outer-periphery coating material SCd of the thin coaxial cable SC.

More specifically, the both-side flange plates constituting the second fixing/retaining plates 13*b*4 and the third fixing/retaining plates 13*b*5 are disposed so as to be positioned in the both-side outer sides of the cable shield conductor (shield line) SCb and the outer-periphery coating material SCd of the thin coaxial cable SC when the shell cover part 13*b* is pushed down to the approximately horizontal state, and the flange plates are bent to the connector inner side so as to carry out swaging in the state. As a result, the shell cover part 13*b* is fixed with respect to the cable shield conductor (shield line) SCb and the outer-periphery coating material SCd of the thin coaxial cable SC, and the ground circuit of the shield shell 13 is configured to be formed when the cable shield conductor SCb is brought into contact with the second fixing/retaining plates 13*b*4.

On the other hand, the shell insertion part 13*a*1 constituting a lower part of the shield shell 13 in the above described manner is configured to be externally mated with a radial-direction outer part of the mating connector (for example, receptacle connector) serving as a mating counterpart and constitutes a connector coupling part together with the insulating insertion part 11*b* of the insulating housing 11, which is inserted in the radial-direction inner side of the above described mating connector. More specifically, the shell insertion part 13*a*1 is formed so as to have an approximately cylindrical shape, and a coupling/engaging part consisting of an annular recessed groove projecting toward the radial-direction inner side is formed at the lower end part of the insertion side of the shell insertion part 13*a*1. The coupling/engaging part is configured to be in an elastic mating relation with respect to a coupling/engaging part (illustration omitted) provided on the mating connector, which is a mating counterpart, when the shell cover part 13*b* is pushed down to the approximately horizontal state in the above described manner.

[About Signal Electrically-Conductive Contact]

The internal conductor contact (signal electrically-conductive contact) 12 employed in the present embodiment is attached to the insulating main-body part 11*a* of the above described insulating housing 11, for example, by press-fitting or insert molding. The internal conductor contact 12 has a cable sandwiching part consisting of a pair of upper/lower beam parts 12*a* and 12*b*, which is connected to the cable center conductor (signal line) SCa of the thin coaxial cable SC. An elastic spring part 12*c* provided so as to be extended from the lower beam part 12*b* of the cable sandwiching part toward the lower side is configured to be brought into elastic contact with an electrically-conductive contact (illustration omitted) provided on the mating connector (for example, receptacle connector).

The upper beam part 12*a* and the lower beam part 12*b* constituting the cable sandwiching part is formed of a continuously extending band-plate-like member and has a clip beam structure, which is formed to be bent so as to form an approximately C-shape or an approximately L-shape in a lateral view. As described later, a coupling part of both of them is subjected to bending deformation in a direction in which the upper beam part 12*a* gets closer to the lower beam part 12*b*, thereby providing a structure which sandwiches the cable center conductor (signal line) SCa of the thin coaxial cable SC between the both beam parts 12*a* and 12*b* from the upper and lower sides like a clip.

Herein, in the initial state which is a stage before the terminal part of the above described thin coaxial cable SC is coupled, the upper beam part 12*a* of the cable sandwiching part is formed of a tongue-shaped member rising obliquely upward particularly as shown in FIG. 8. Since the upper beam part 12*a* serving as the tongue-shaped part is in an upper-side open state, the upper beam part 12*a* is brought into a state in which it is separated to the upper side from the lower beam part 12*b*.

On the other hand, the lower beam part 12*b* of the cable sandwiching part is formed as a cable placing part on which the cable center conductor SCa of the thin coaxial cable SC is placed, and the lower beam part 12*b* is extended approximately horizontally from the part coupled with the upper beam part 12*a* toward the connector front side. When the terminal part of the thin coaxial cable SC is placed on the cable supporting part 11*c* of the insulating housing 11 in the above described manner, the cable center conductor SCa of the thin coaxial cable SC is placed on the surface of the surface of the lower beam part 12*b* of the cable sandwiching part.

Figure 6:
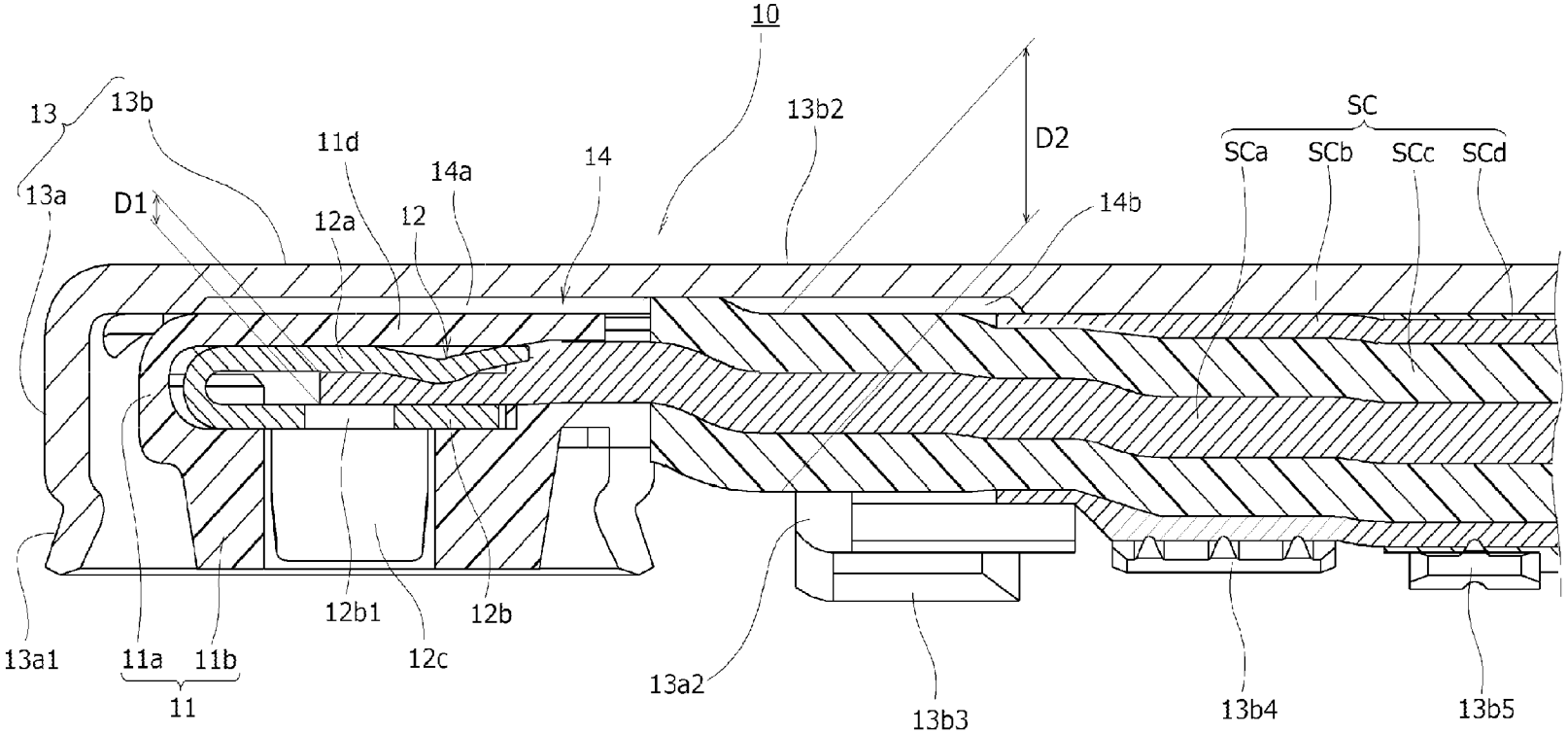
FIG. 6 is a vertical cross-sectional explanatory view along a line VI-VI in FIG. 4.

After the terminal part of the thin coaxial cable SC is placed on the cable supporting part 11*c* of the insulating housing 11 and brought into a set state in this manner, the shell cover part 13*b* of the shield shell 13 is pushed down to the approximately horizontal state together with the above described insulative pressing plate 11*d*. In this process, the upper beam part 12*a* of the cable sandwiching part pushed to the lower side by the insulative pressing plate 11*d* is subjected to bending deformation so as to be pushed down until it becomes an approximately horizontal state, and the upper beam part 12*a* is configured to press the cable center conductor (signal line) SCa from the upper side particularly as shown in FIG. 6.

Herein, an extending-direction intermediate position of the upper beam part 12*a* constituting the above described cable sandwiching part is formed into an upper electrode part, which presses the cable center conductor (signal line) SCa from the upper side. The upper electrode part provided in the upper beam part 12*a* of the signal electrically-conductive contact 12 is formed into a bent shape projecting downward to sandwich the thin coaxial cable SC, and the lower bent-shape part thereof is formed into a projecting contact part projecting toward the thin coaxial cable SC side. This projecting contact part is configured to be pressure-contacted with the cable center conductor (signal line) SCa of the thin coaxial cable SC, which is set on the lower beam part 12*b*, from the upper side when the shell cover part 13*b* is pushed down to the approximately horizontal state in the above described manner. The cable center conductor (signal line) SCa is configured to be sandwiched in a pressure-contacted state between the upper beam parts 12*a* and 12*b* of both of the beam parts and establish electrical connection.

The lower beam part 12*b* provided as the cable placing part of the above described electrically-conductive contact 12 is formed of a plate-like member which forms a flat shape and is extended to the front side from the part coupled to the upper beam part 12*a*, which forms the tongue-shaped part, and the lower beam part 12*b* is fixed in a state placed on the upper surface of the insulating main-body part 11*a* of the above described insulating housing 11. A connection monitoring hole 12*b*1 forming a round hole shape is formed to penetrate through an approximately center part of the lower beam part 12*b*, and a contact insertion hole of the mating connector is formed to penetrate through the insulating housing 11 so as to be approximately coaxial with the connection monitoring hole 12*b*1. The contact insertion hole of the mating connector also functions as a connection monitoring hole, and the disposed state of the cable center conductor (signal line) SCa of the thin coaxial cable SC can be visually checked from the lower side through the above described connection monitoring hole 12*b*1.

The lower beam part 12*b* of the cable sandwiching part is formed of the band-plate-like member extending in the connector front-back direction as described above. The pair of elastic spring parts 12*c* and 12*c* at a predetermined interval therebetween are integrally extended toward the lower side from plate-width-direction (left-right-direction) both-side edge parts of the lower beam part 12*b*. A pin-shaped signal electrically-conductive contact (illustration omitted) provided on the mating connector (for example, receptacle connector) is configured to be inserted in a pressure-contacted state in the part between both of the elastic spring parts 12*c* and 12*c* and electrically connected therewith.

When the shell cover part 13*b* of the shield shell 13 in the upper-side open state in the initial state in the above described manner is pushed down toward the lower side, the insulative pressing plate 11*d* of the insulating housing 11, which is also in the upper-side open state in the initial state, is opposed to a predetermined region of the cover inner surface of the shell cover part 13*b* from the lower side, brought into a pressure-contacted state and is then pushed down to an approximately horizontal state together with the shell cover part 13*b*. Thus, the shell cover part 13*b* and the insulating pressing plate 11*d* are disposed in a multi-layer shape in the upper side of the cable center conductor (signal line) SCa via the upper beam part 12*a* of the internal electrically-conductive contact (signal electrically-conductive contact) 12. At this point, in the opposed region of the pressure contact of the cover inner surface of the shell cover part 13*b* and the insulative pressing plate 11*d*, a void part 14 forming a thin long recessed-groove shape is provided so as to be extended in the connector front-back direction along the cable-shaped signal transmission medium SC.

The void part 14 in the present embodiment is formed by an inner wall surface of a recessed groove-shaped part which is a partial dent of the inner surface of the shell cover part 13*b*. The recessed groove-shaped part constituting the void part 14 is formed, for example, by pressing and is provided by reducing the plate thickness of the shell cover part 13*b* by the groove depth of the recessed groove-shaped part constituting the void part 14. The recessed groove-shaped part constituting the void part 14 is provided by separating at least one of the cover inner surface of the shell cover part 13*b* and the insulative pressing plate 11*d* from the other one. Like an eighth embodiment which will be described later, the recessed groove-shaped part constituting the void part may be provided on the insulative pressing plate 11*d*, or recessed groove-shaped parts constituting a void part can be provided on the both members.

As described above, the recessed groove-shaped part constituting the void part 14 in the above described manner is extended along the cable-shaped signal transmission medium SC; wherein, a longitudinal-direction extended range of the recessed groove-shaped part constituting the void part 14 is set to a range from the coupled part of the lower beam part (cable placing part) 12*b* and the upper beam 12*a* serving as a rear end part of the internal electrically-conductive contact (signal electrically-conductive contact) 12 to a position above the part at which the dielectric body SCc of the cable-shaped transmission medium SC is exposed.

More specifically, particularly as shown in FIG. 9 to FIG. 12, the recessed groove-shaped part constituting the void part 14 in the present embodiment is provided with a narrow first recessed groove-shaped part 14*a*, which is positioned above a region in which the cable center conductor SCa of the thin coaxial cable SC is electrically connected (hereinafter, referred to as "electrical connection region"), and a thick second recessed groove-shaped part 14*b*, which is positioned above the dielectric body SCc of the thin coaxial cable SC so that the first and second recessed groove-shaped parts 14*a* and 14*b* are linearly continued. Particularly as shown in FIG. 4, the first recessed groove-shaped part 14*a* disposed in the electrical connection region has a groove width W1a which is formed so as to be smaller than a plate width W2 of the above described insulative pressing plate 11*d* in the electrical connection region (W1a<W2).

Herein, a region corresponding to a groove-width-direction both sides of the void part 14 is formed into the cover inner surface of the shell cover part 13*b*. The cover inner surface of the shell cover part 13*b* positioned in the both sides of the first recessed groove-shaped part 14*a* disposed in the above described electrical connection region is formed into a drop preventing part 13*b*6 which abuts the upper surface of the insulative pressing plate 11*d* from the upper side. More specifically, the drop preventing part 13*b*6 abuts the upper surface of the insulative pressing plate 11*d* and is therefore in a relation that it is stacked above the insulative pressing plate. Therefore, the insulative pressing plate 11*d* does not enter the interior of the first recessed groove-shaped part 14*a* disposed in the electrical connection region of the void part 14 so that the void part 14 is reliably formed in the electrical connection region.

Figure 9:
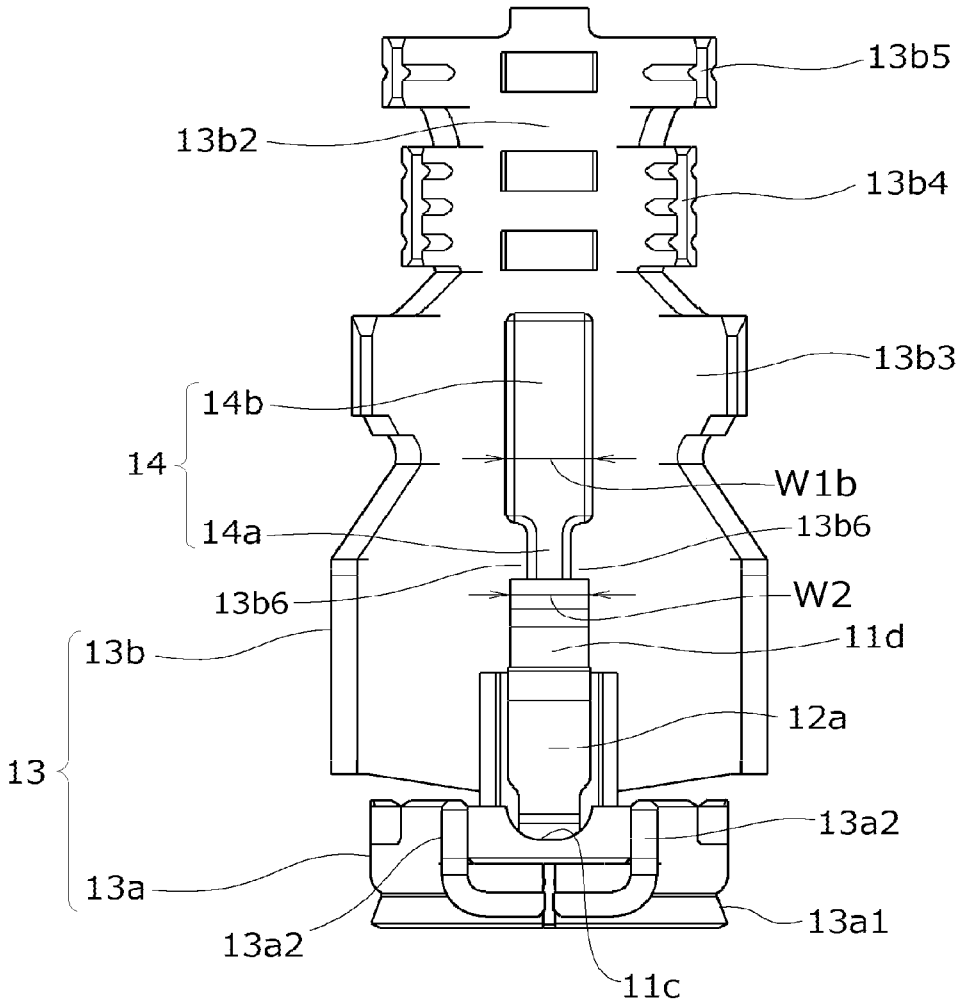
FIG. 9 is a front explanatory view of the coaxial electric connector (plug connector) shown in FIG. 8.
Figure 10:
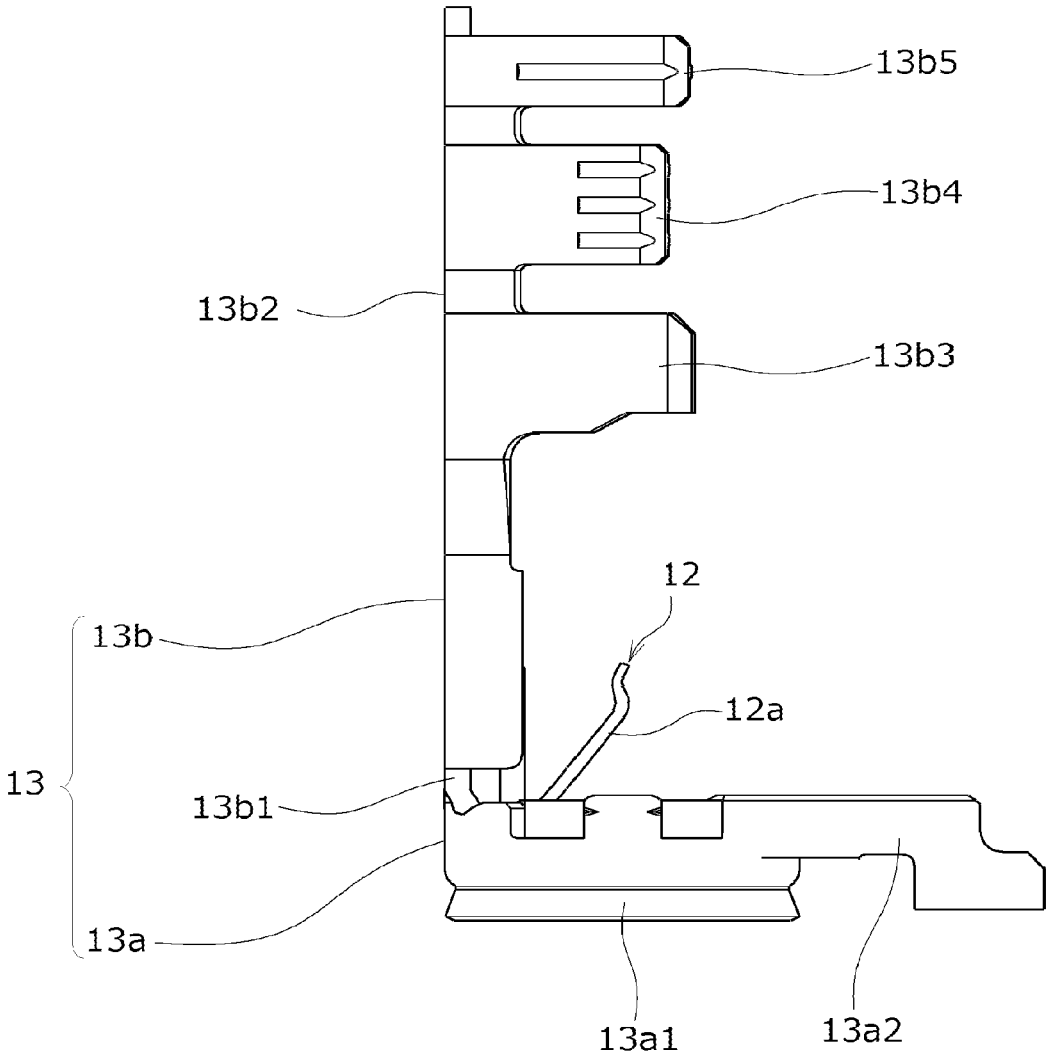
FIG. 10 is an explanatory lateral view of the coaxial electric connector (plug connector) shown in FIG. 8.
Figure 11:
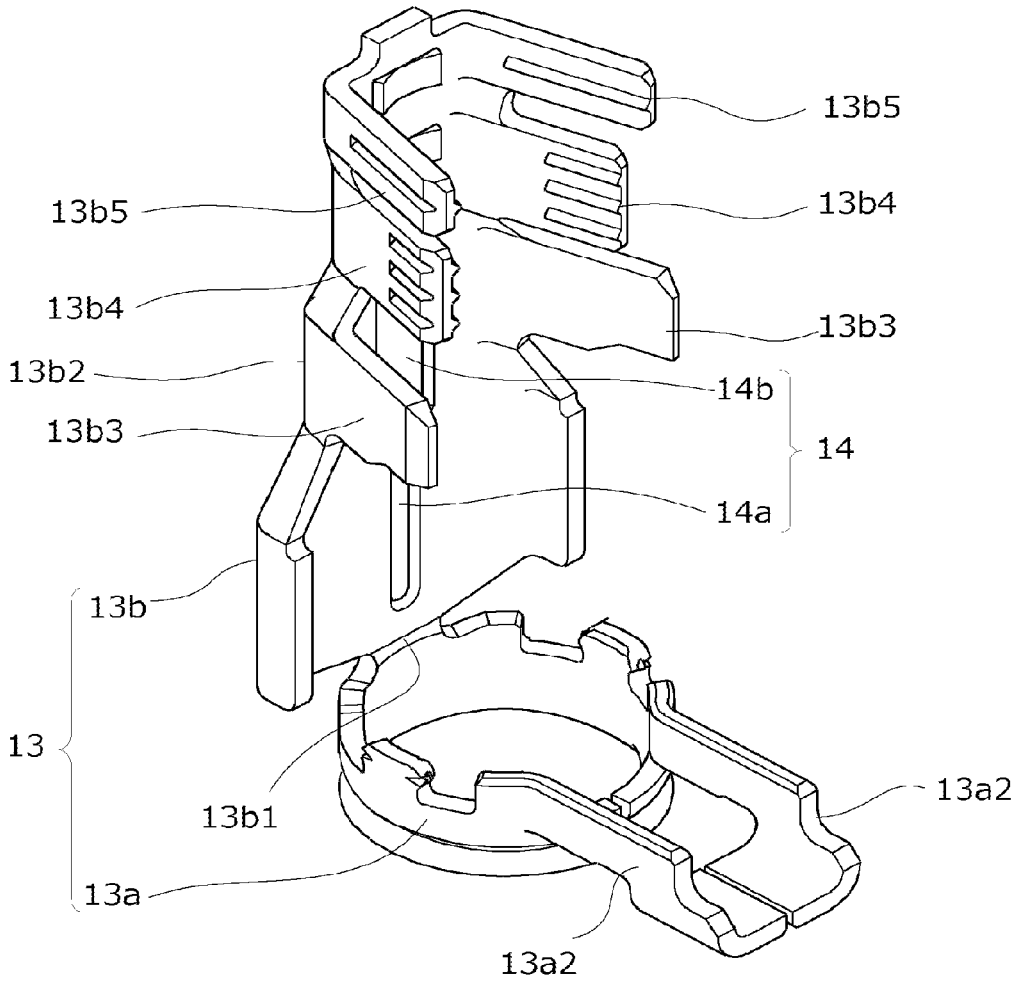
FIG. 11 is an external-appearance explanatory perspective view showing an initial open state of a single shield shell used in the coaxial electric connector (plug connector) according to the first embodiment of the present invention.
Figure 12:
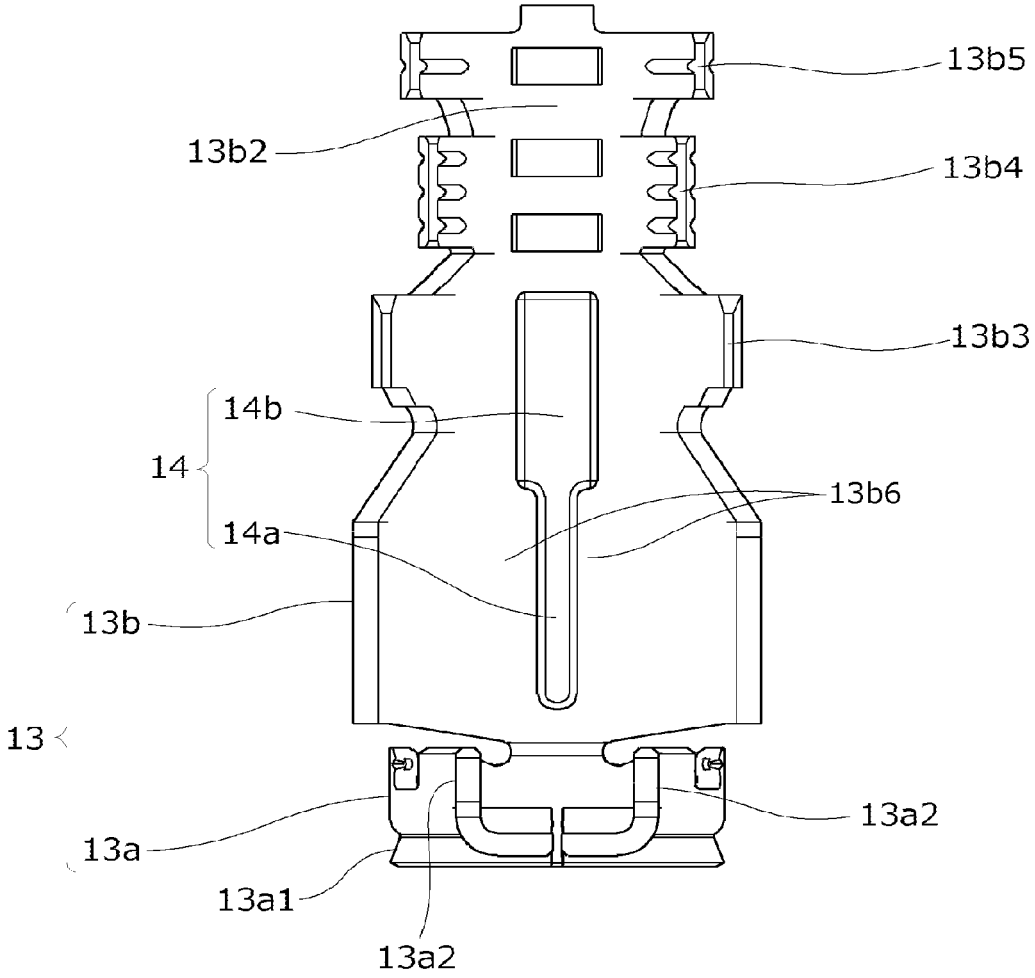
FIG. 12 is a front explanatory view of the single shield shell shown in FIG. 11.

On the other hand, the groove width W1b of the wide second recessed groove-shaped part 14*b* is formed to be larger than the plate width W2 of the insulative pressing plate 11*d* particularly as shown in FIG. 9 (W1b>W2). The insulative pressing plate 11*d* in the present embodiment is extended only to an intermediate position of the first recessed groove-shaped part 14*a* in the direction of the extending length, wherein the insulative pressing plate 11*d* is configured not to be opposed to the wide second recessed groove-shaped part 14*b*. Therefore, even in a closed state in which the shell cover part 13*b* of the shield shell 13 is pushed down, the insulative pressing plate 11*d* does not enter the interior of the wide second groove-shaped part 14*b*, and the insulative pressing plate 11*d* is retained in a multi-layer state in which the insulative pressing plate 11*d* is in pressure-contact with the inner surface of the shell cover part 13*b* across the entire length thereof. The shell cover part 13*b* is maintained in a state stacked above the insulative pressing plate 11*d*, and the void part 14 is configured to be disposed at an immediately above position of the insulative pressing plate 11*d*.

The wide second recessed groove-shaped part 14*b*, which forms another region of the void part 14 somewhat distant from the electric connection region, is disposed at the position corresponding to an exposed part of the dielectric body SCc of the thin coaxial cable SC as described above. The groove width W1b of the wide second recessed groove-shaped part 14*b* is formed so as to be somewhat larger than the outer diameter D2 (see FIG. 6) of the dielectric body SCc of the thin coaxial cable SC (W1b>D2). Therefore, the dielectric body SCc of the thin coaxial cable SC is housed in the interior of the wide second recessed groove-shaped part 14*b* of the void part 14, and, by virtue of this, the height of the connector is reduced.

The groove width W1b of the second recessed groove-shaped part 14*b* is set to be larger than the plate width W2 of the insulative pressing plate 11*d* (W1b>W2) as described above and is set to be larger than a plate width W3 of the internal conductor contact 12 in the electrical connection region (W1b>W3).

Furthermore, the groove width W1a of the narrow first recessed groove-shaped part 14*a* constituting the void part 14 in the above described manner is set to be equal to or larger than a wire diameter D1 (see FIG. 6) of the cable center conductor (signal line) SCa of the cable-shaped signal transmission medium SC, in other words, the part in contact with the internal electrically-conductive contact (signal electrically-conductive contact) 12 (W1a≥D1). Furthermore, the groove width W1a of the narrow first groove-shaped part 14*a* constituting the void part 14 is set to be smaller than the plate width W3 (see FIG. 4) of the upper beam part 12*a* of the internal electrically-conductive contact (signal electrically-conductive contact) 12 (W1<W3).

According to the present embodiment having such a structure, since the void part 14 is provided in the opposed region of the cover inner surface of the shell cover part 13*b* and the insulative pressing plate 11*d*, the dielectric constant thereof is correspondingly reduced, the electrostatic capacity thereof is reduced, and the characteristic impedance about the cable-shaped signal transmission medium SC is adjusted by the void part 14. Therefore, the matching degree (VSWR) of the characteristic impedance with respect to transmission signals is easily and appropriately matched, and transmission of high-frequency signals is carried out well.

Particularly, the void part 14 in the present embodiment is formed by the recessed groove extending along the cable-shaped signal transmission medium SC. Therefore, the characteristic impedance with respect to the cable-shaped signal transmission medium SC is more reliably adjusted, and the void part 14 like this is easily and reliably formed.

Furthermore, the void part 14 of the present embodiment is provided with the drop preventing part 13*b*6, which regulates drop of the insulative pressing plate 11*d* into the void part 14. Therefore, the cover inner surface of the shell cover part 13*b* and the insulative pressing plate 11*d* are maintained in a good separated state so that the void part 14 is reliably formed.

Furthermore, in the present embodiment, the groove width W1a of the narrow first recessed groove-shaped part 14*a* constituting the electrical connection region of the void part 14 is set to be smaller than the plate width W2 of the insulative pressing plate 11*d* (W1a<W2). Therefore, entrance of the insulative pressing plate 11*d* into the void part 14 is regulated, and the void part 14 is ensured well. The groove width W1b of the wide second recessed groove-shaped part 14*b* constituting the other region of the void part 14 is set to be larger than the plate width W2 of the insulative pressing plate 11*d* (W1b>W2). Therefore, the characteristic impedance with respect to the cable-shaped signal transmission medium SC is adjusted better.

In addition to that, the first and second groove parts 14*a* and 14*b* constituting the void part 14 in the present embodiment are formed by reducing the plate thickness of the shell cover part 13*b*. Therefore, the thickness of the shell cover part 13*b*1 is not increased by the formation of the void part 14, and the void part 14 does not become an obstacle of height reduction of the connector.

Figure 13:
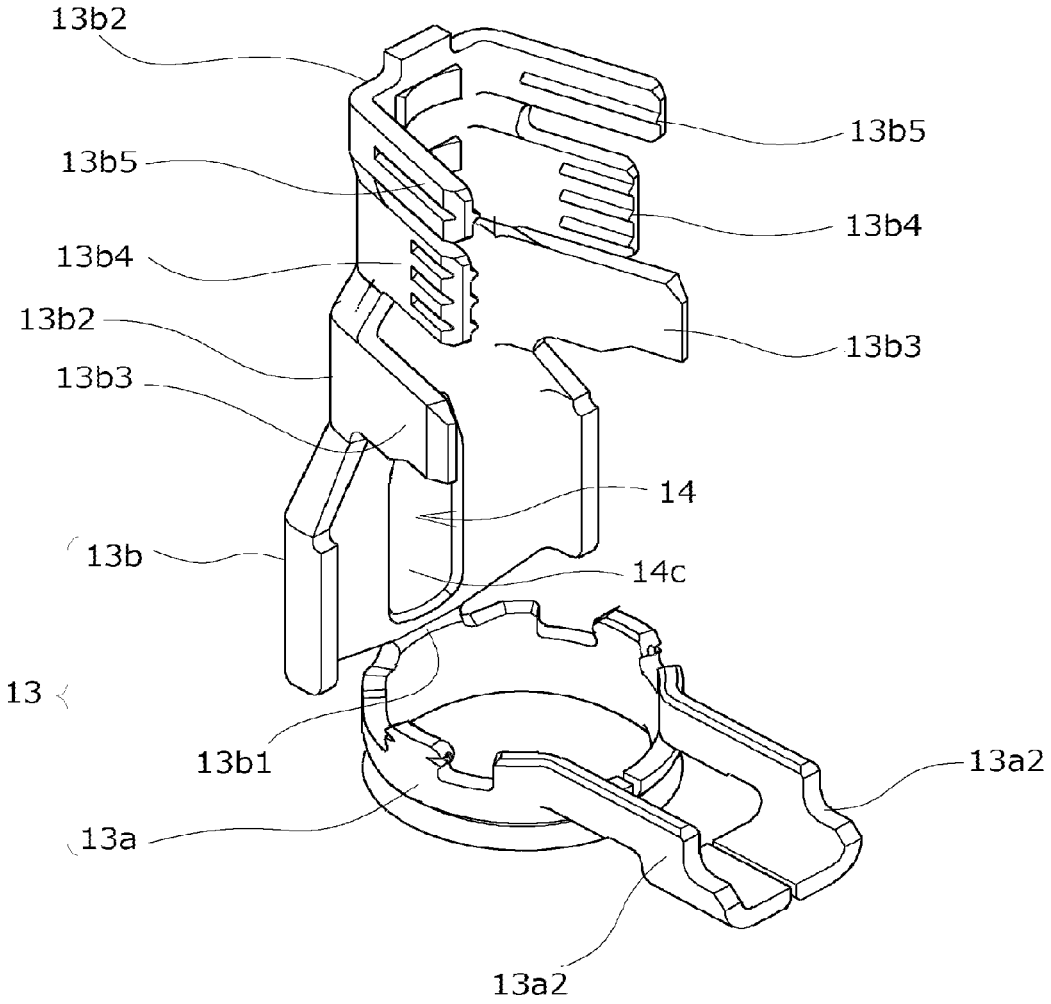
FIG. 13 is an external-appearance explanatory perspective view showing an initial open state of a single shield shell used in a coaxial electric connector (plug connector) in a second embodiment of the present invention.
Figure 14:
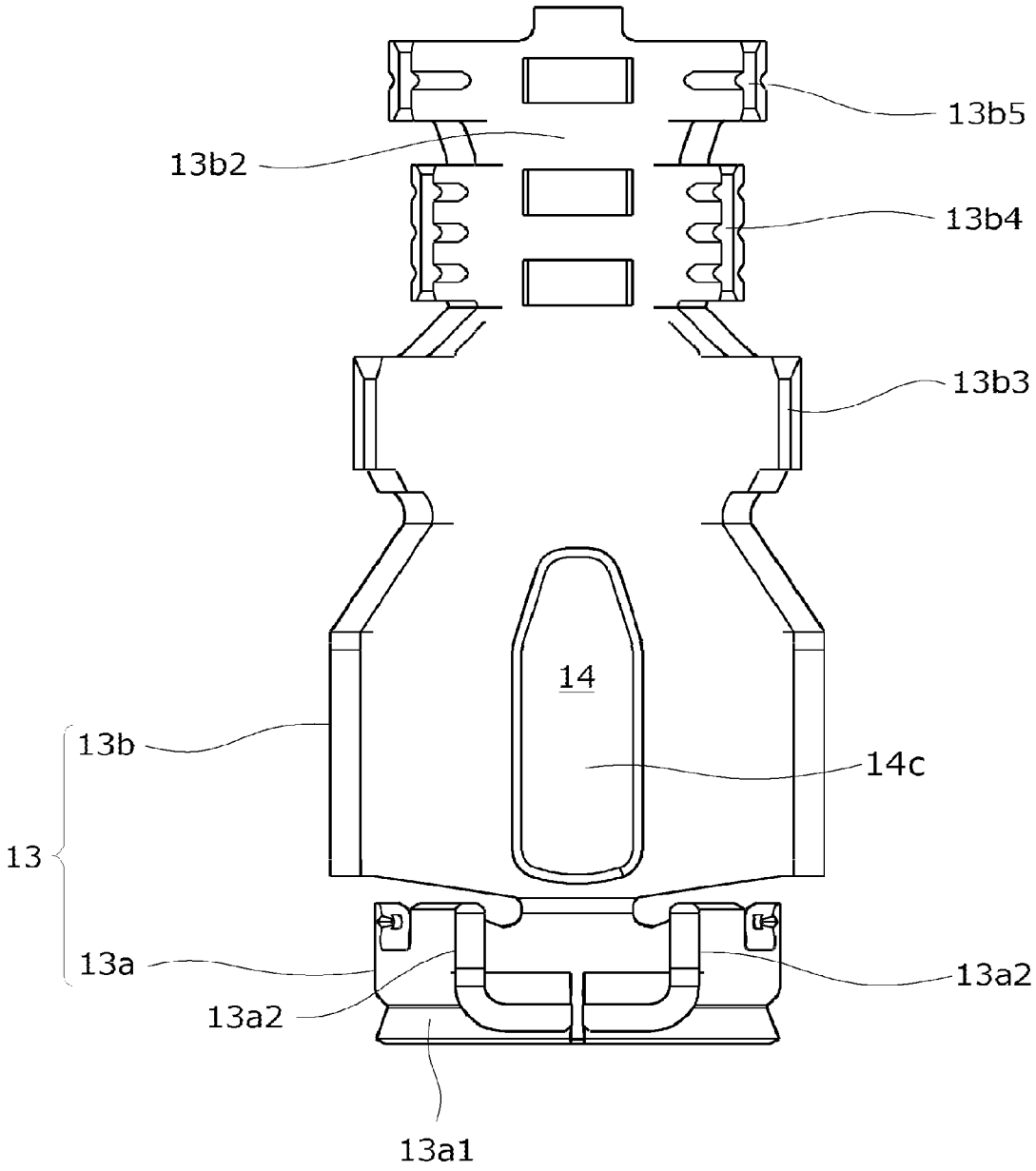
FIG. 14 is an explanatory front view of the single shield shell shown in FIG. 13.

On the other hand, in a second embodiment according to FIG. 13 and FIG. 14 in which the same constituent members as those of the above described first embodiment are denoted by the same reference signs, the shape of a recessed groove-shaped part 14*c* constituting the void part 14, which is positioned above the cable center conductor SCa of the thin coaxial cable SC, is different.

More specifically, although the recessed groove-shaped part 14*c* in the present embodiment is also provided on the cover inner surface of the shell cover part 13*b*, the part is formed to have a shorter length than that of the embodiment as described above, and the part positioned above the dielectric body SCc of the thin coaxial cable SC is formed by the inner surface of the shell cover part 13*b*.

The recessed groove-shaped part 14*c* constituting the void part 14 in this case has a groove width that is somewhat larger than that of the tip part of the insulative pressing plate 11*d*. However, a rear end part in the root side of the insulative pressing plate 11*d* has a larger plate width than the groove width of the recessed groove-shaped part 14*c*. Therefore, the insulative pressing plate 11*d* does not enter the interior of the recessed groove-shaped part 14*c* constituting the void part 14, and the void part 14 is configured to be formed by the recessed groove-shaped part 14*c*.

Figure 15:
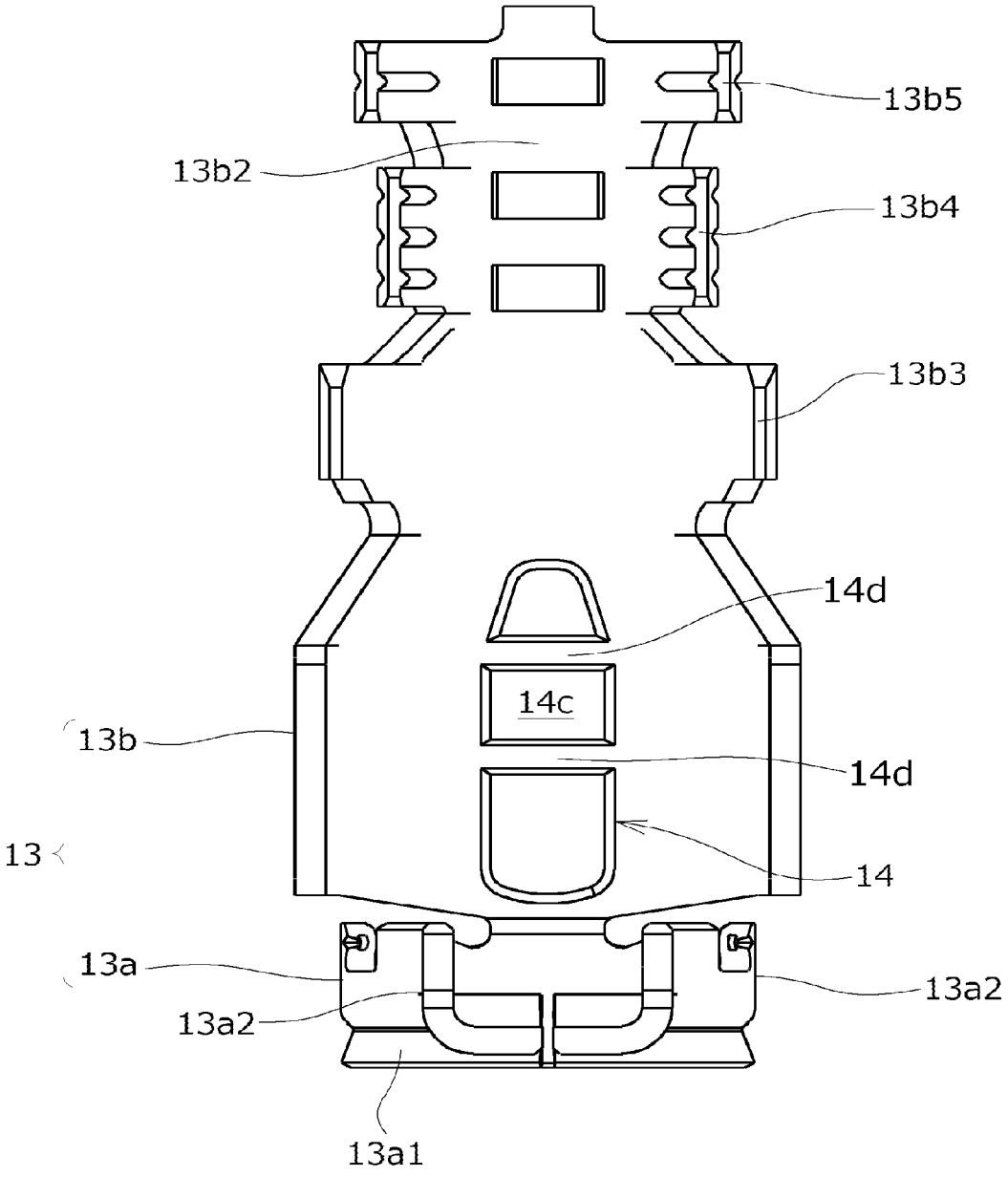
FIG. 15 is an explanatory front view showing an initial open state of a single shield shell used in a coaxial electric connector (plug connector) in a third embodiment of the present invention.
Figure 16:
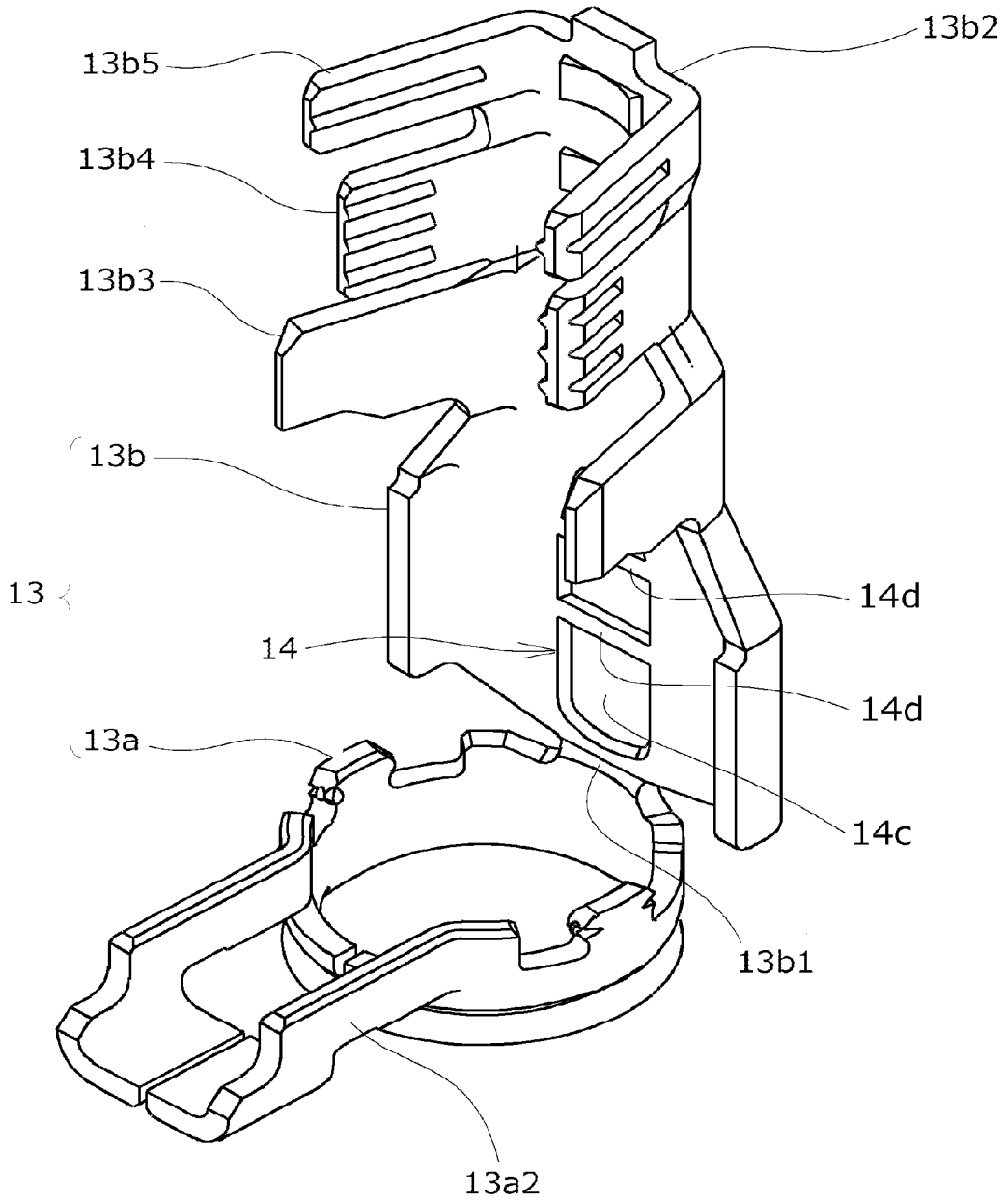
FIG. 16 is an external-appearance explanatory perspective view of the single shield shell shown in FIG. 15.

In a third embodiment according to FIG. 15 and FIG. 16 in which the same constituent members as those of the above described embodiments are denoted by the same reference signs, a recessed groove-shaped part 14*c* similar to that of the second embodiment is formed on the cover inner surface of the shell cover part 13*b*1, and the recessed groove-shaped part 14*c* in the present embodiment is provided with a pair of drop preventing parts 14*d* and 14*d*, which are extended approximately in parallel toward a groove-width direction. Each of the drop preventing parts 14*d* is formed so as to form an equal-height surface continued from the cover inner surface of the shell cover part 13*b*. When the drop preventing parts 14*d* and 14*d* abut the surface of the insulative pressing plate 11*d*, the insulative pressing plate 11*d* is reliably prevented from entering the interior of the recessed groove-shaped part 14*c* so that the void part 14 is reliably formed by the recessed groove-shaped part 14*c*.

Figure 17:
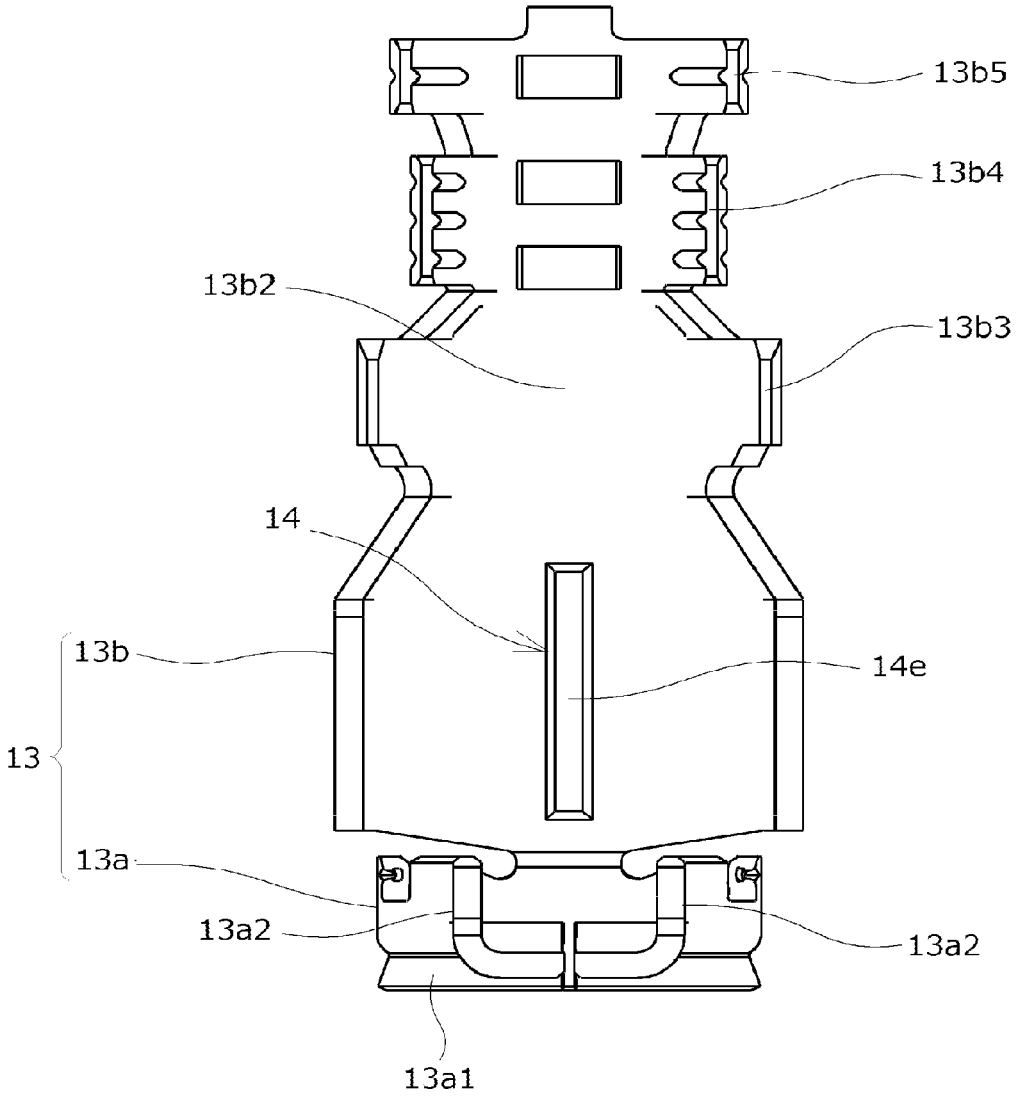
FIG. 17 is an explanatory front view showing an initial open state of a single shield shell used in a coaxial electric connector (plug connector) in a fourth embodiment of the present invention.
Figure 18:
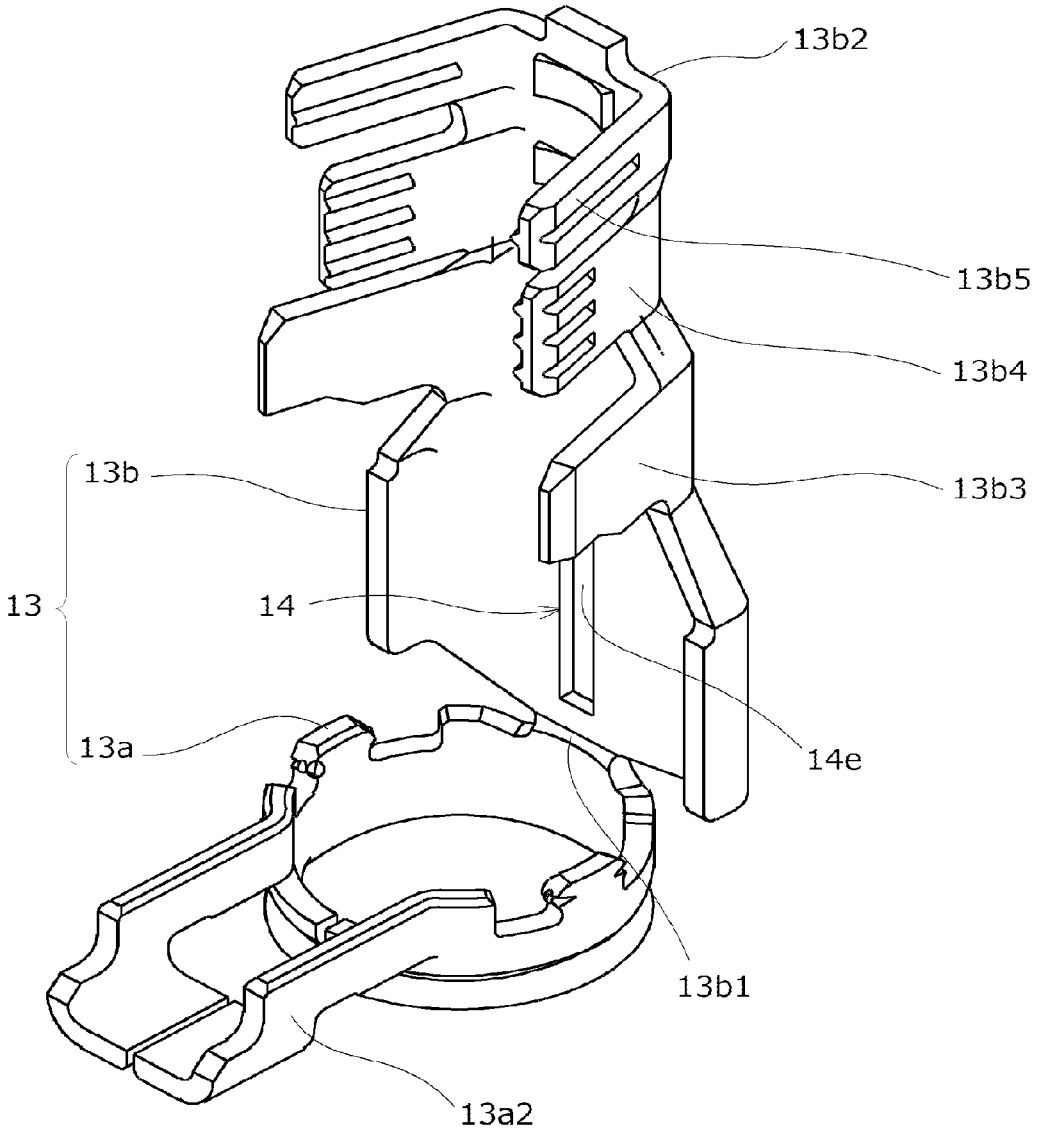
FIG. 18 is an external-appearance explanatory perspective view of the single shield shell shown in FIG. 17.

Furthermore, in a fourth embodiment according to FIG. 17 and FIG. 18 in which the same constituent members as those of the above described embodiments are denoted by the same reference signs, a recessed groove-shaped part 14*e* having a narrow width similar to that of the first recessed groove-shaped part 14*a* of the first embodiment is formed on the inner surface of the shell cover part 13*b*1 so as to form the void part 14 positioned above the cable center conductor SCa of the thin coaxial cable SC. The part positioned above the dielectric body SCc of the thin coaxial cable SC consists of the cover inner surface of the shell cover part.

Figure 19:
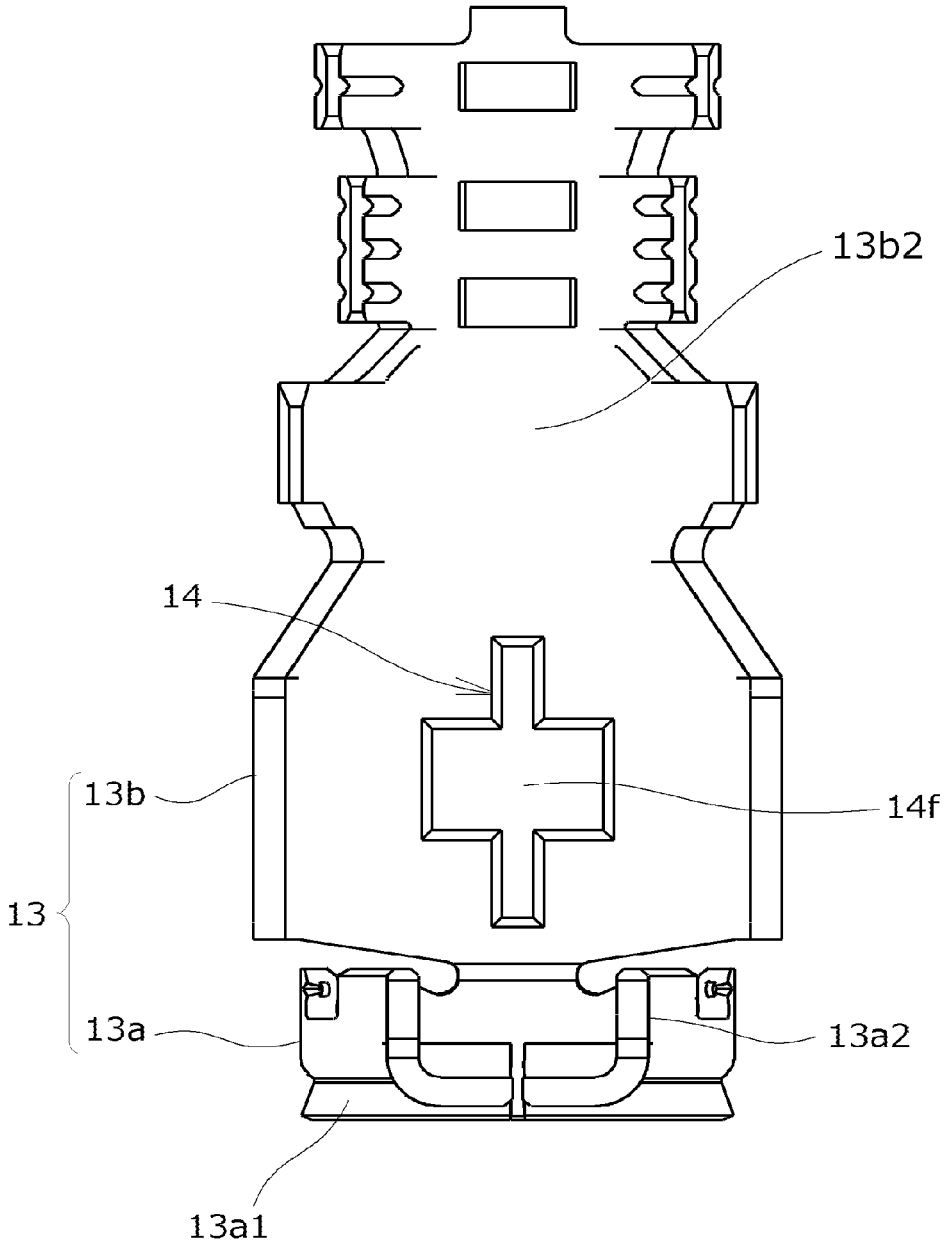
FIG. 19 is an explanatory front view showing an initial open state of a single shield shell used in a coaxial electric connector (plug connector) in a fifth embodiment of the present invention.
Figure 20:
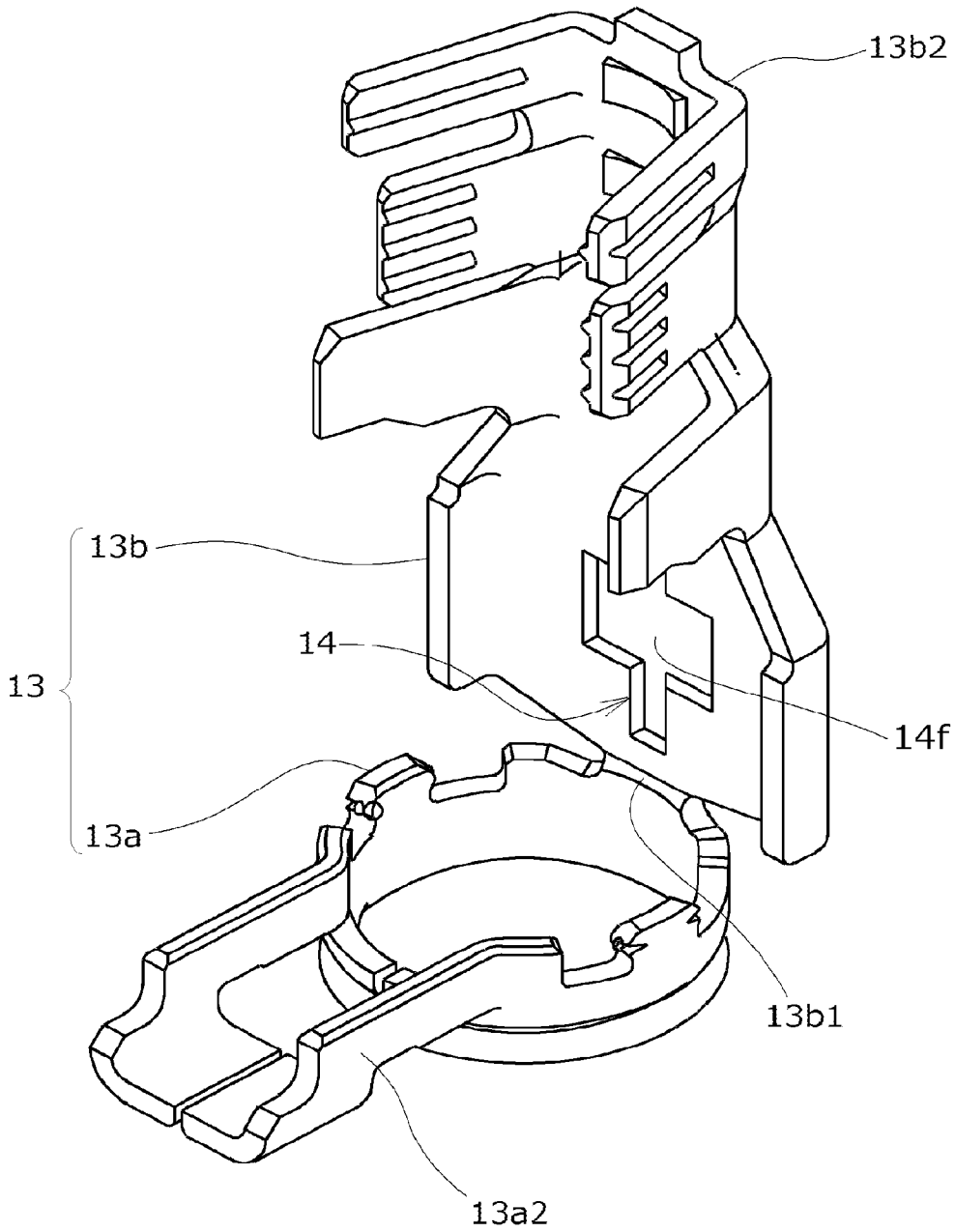
FIG. 20 is an external-appearance explanatory perspective view of the single shield shell shown in FIG. 19.

Furthermore, in a fifth embodiment according to FIG. 19 and FIG. 20 in which the same constituent members as those of the above described embodiments are denoted by the same reference signs, a recessed groove-shaped part 14*f* having a narrow width similar to that of the fourth embodiment is formed on the cover inner surface of the shell cover part 13*b* 1 so as to form the void part 14 positioned above the cable center conductor SCa of the thin coaxial cable SC, and the recessed groove-shaped part 14*f* in the present embodiment has a groove width that is expanded at a longitudinal-direction center part. This groove-width expanded part has a groove width somewhat larger than that of the insulative pressing plate 11*d*, but the groove width thereof in the other part is formed to be smaller than the plate width of the insulative pressing plate 11*d*. Therefore, the insulative pressing plate 11*d* does not enter the interior of the recessed groove-shaped part 14*f* constituting the void part 14, and the void part 14 is formed by the recessed groove-shaped part 14*f*.

Figure 21:
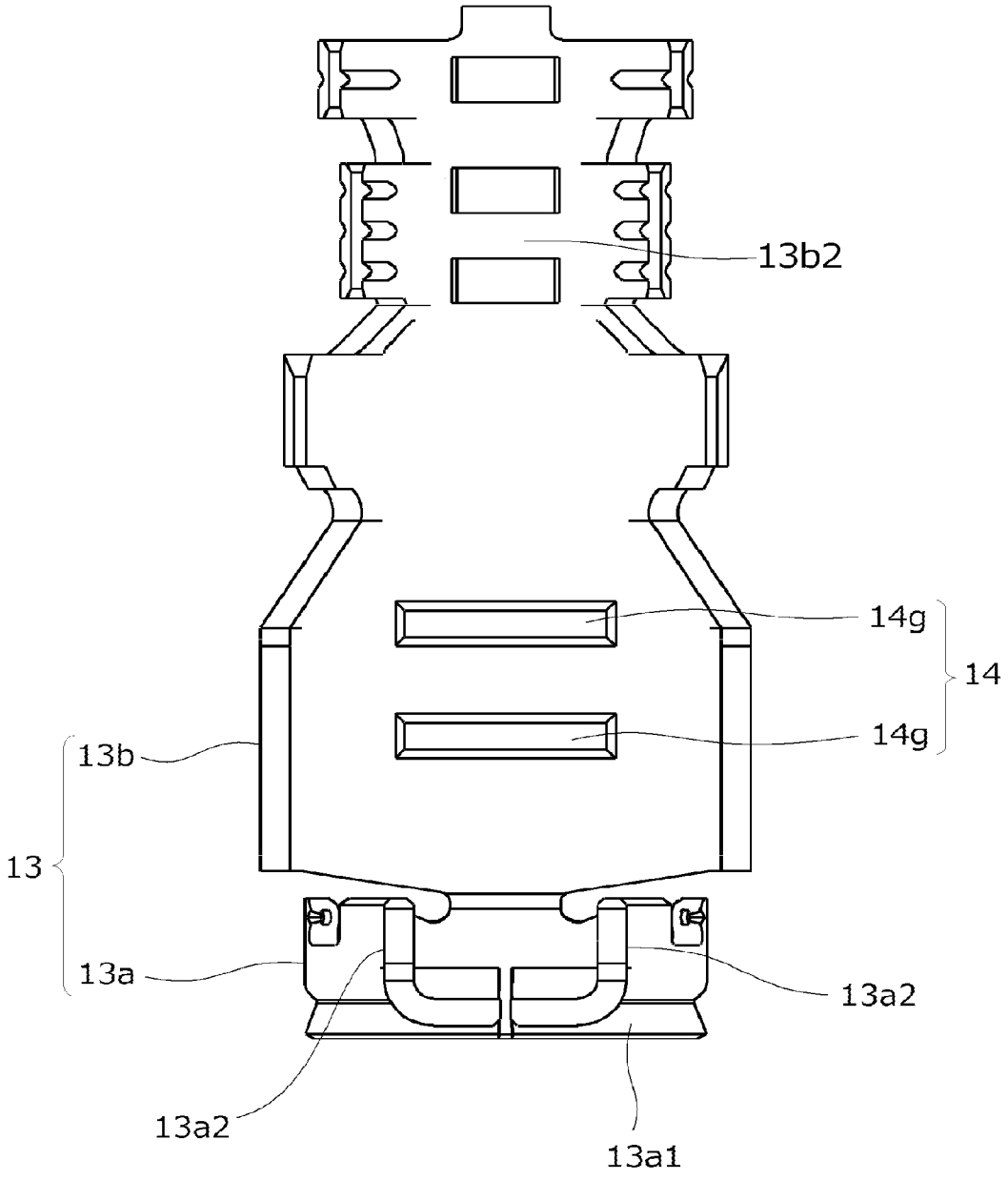
FIG. 21 is an explanatory front view showing an initial open state of a single shield shell used in a coaxial electric connector (plug connector) in a sixth embodiment of the present invention.
Figure 22:
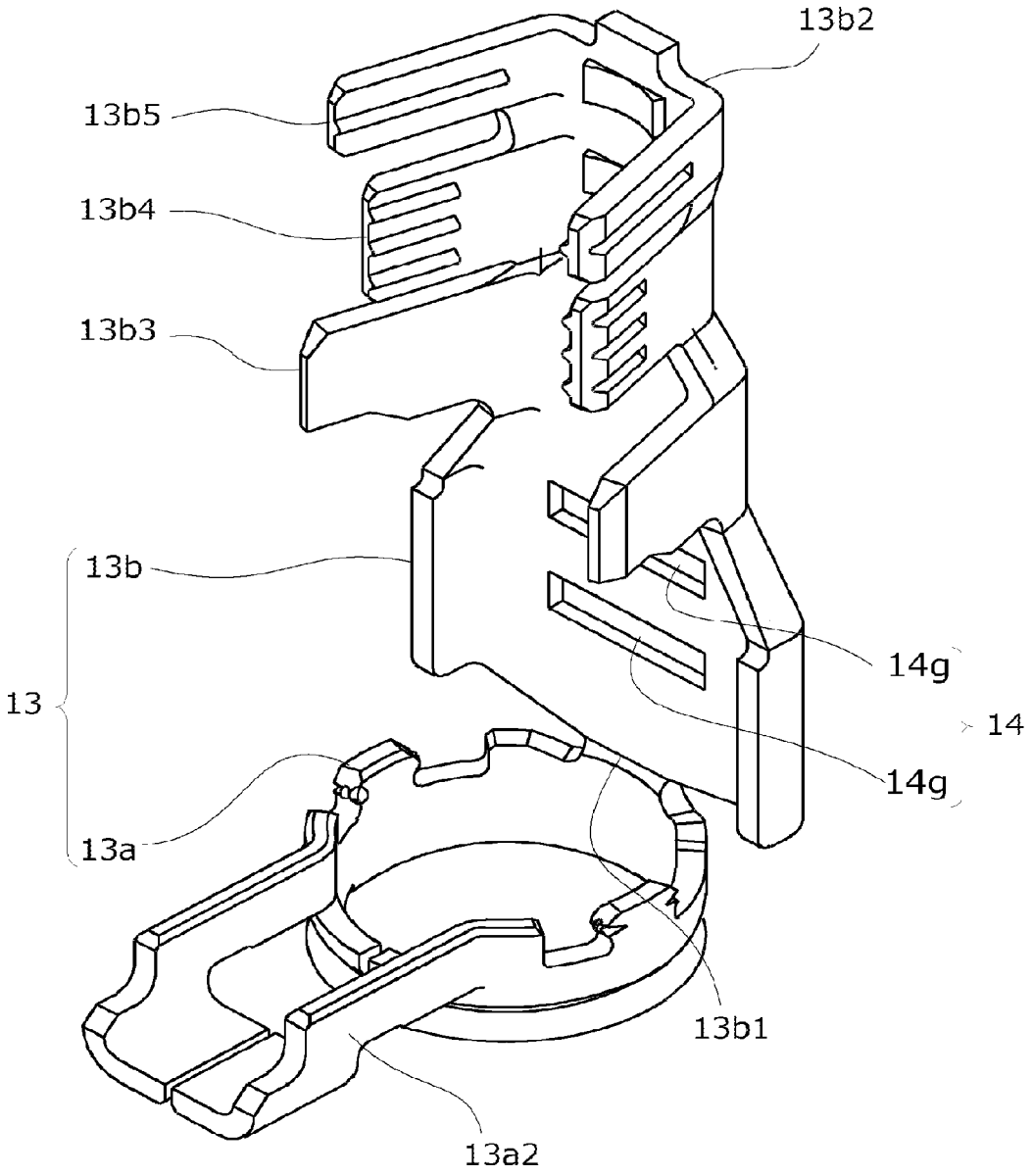
FIG. 22 is an external-appearance explanatory perspective view of the single shield shell shown in FIG. 21.

On the other hand, in a sixth embodiment according to FIG. 21 and FIG. 22 in which the same constituent members as those of the above described embodiments are denoted by the same reference signs, a pair of recessed groove-shaped parts 14*g* and 14*g* extended in the connector left-right direction are formed on the cover inner surface of the shell cover part 13*b*1 so as to form the void part 14 positioned above the cable center conductor SCa of the thin coaxial cable SC. Each of the recessed groove-shaped parts 14*g* of the present embodiment has a groove width somewhat larger than that of the insulative pressing plate 11*d*, and most part of the surface of the insulative pressing plate 11*d* is configured to be received by the cover inner surface of the shell cover part 13*b*1. Therefore, the insulative pressing plate 11*d* does not enter the interior of the recessed groove-shaped parts 14*g* of the void part 14, and the void part 14 is configured to be formed by the recessed groove-shaped parts 14*g*.

Figure 23:
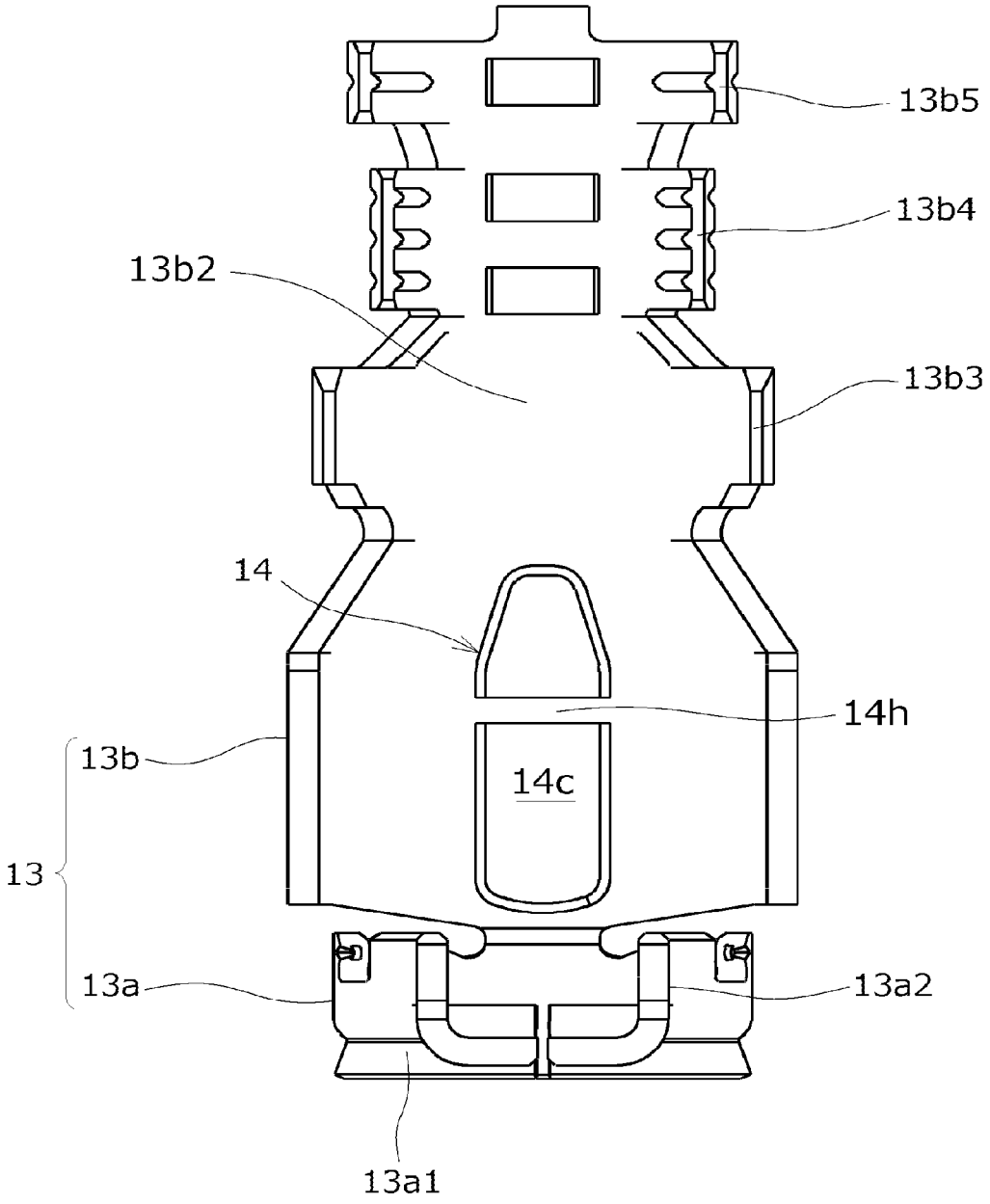
FIG. 23 is an explanatory front view showing an initial open state of a single shield shell used in a coaxial electric connector (plug connector) in a seventh embodiment of the present invention.
Figure 24:
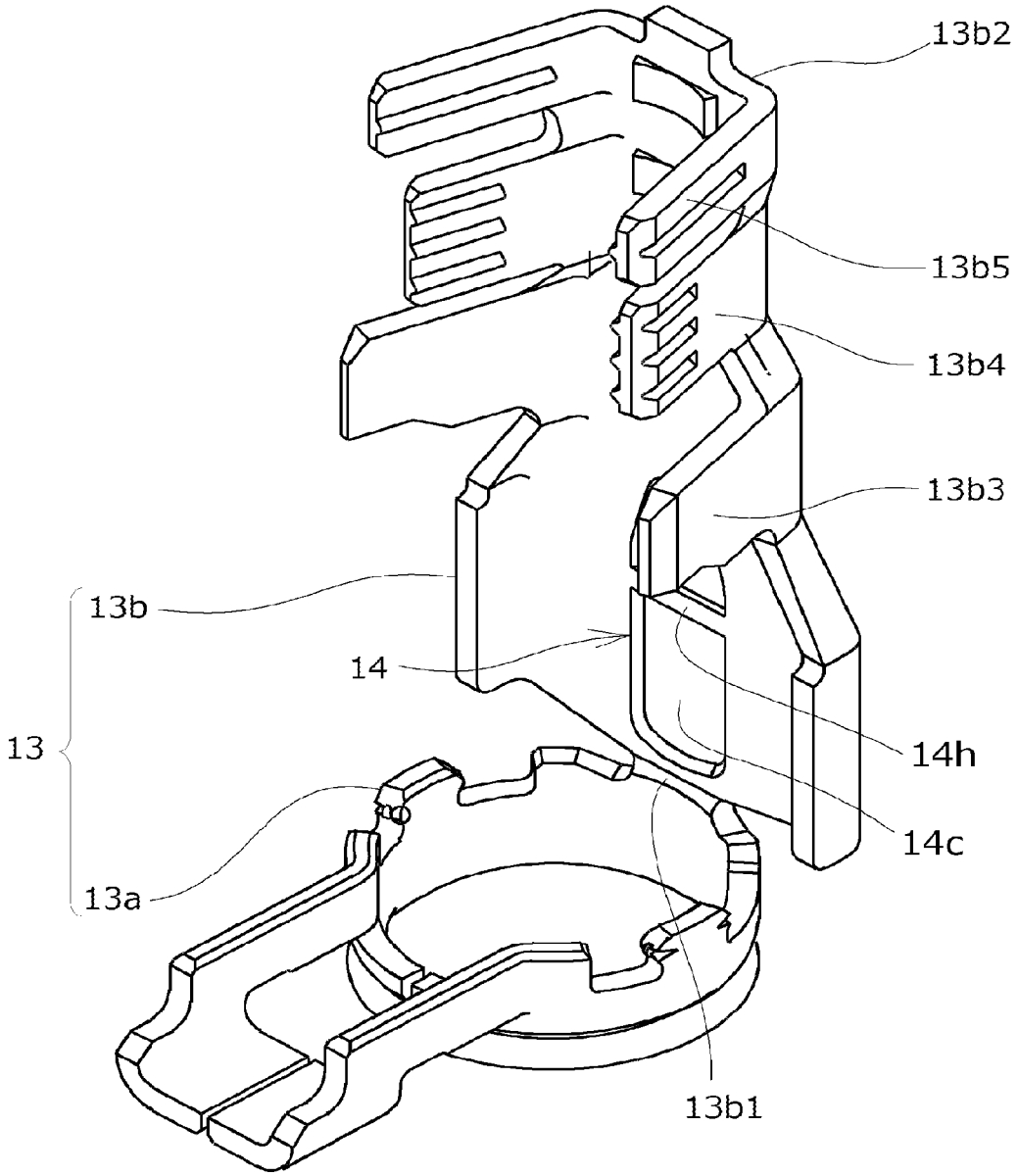
FIG. 24 is an external-appearance explanatory view of the single shield shell shown in FIG. 23.
Figure 25:
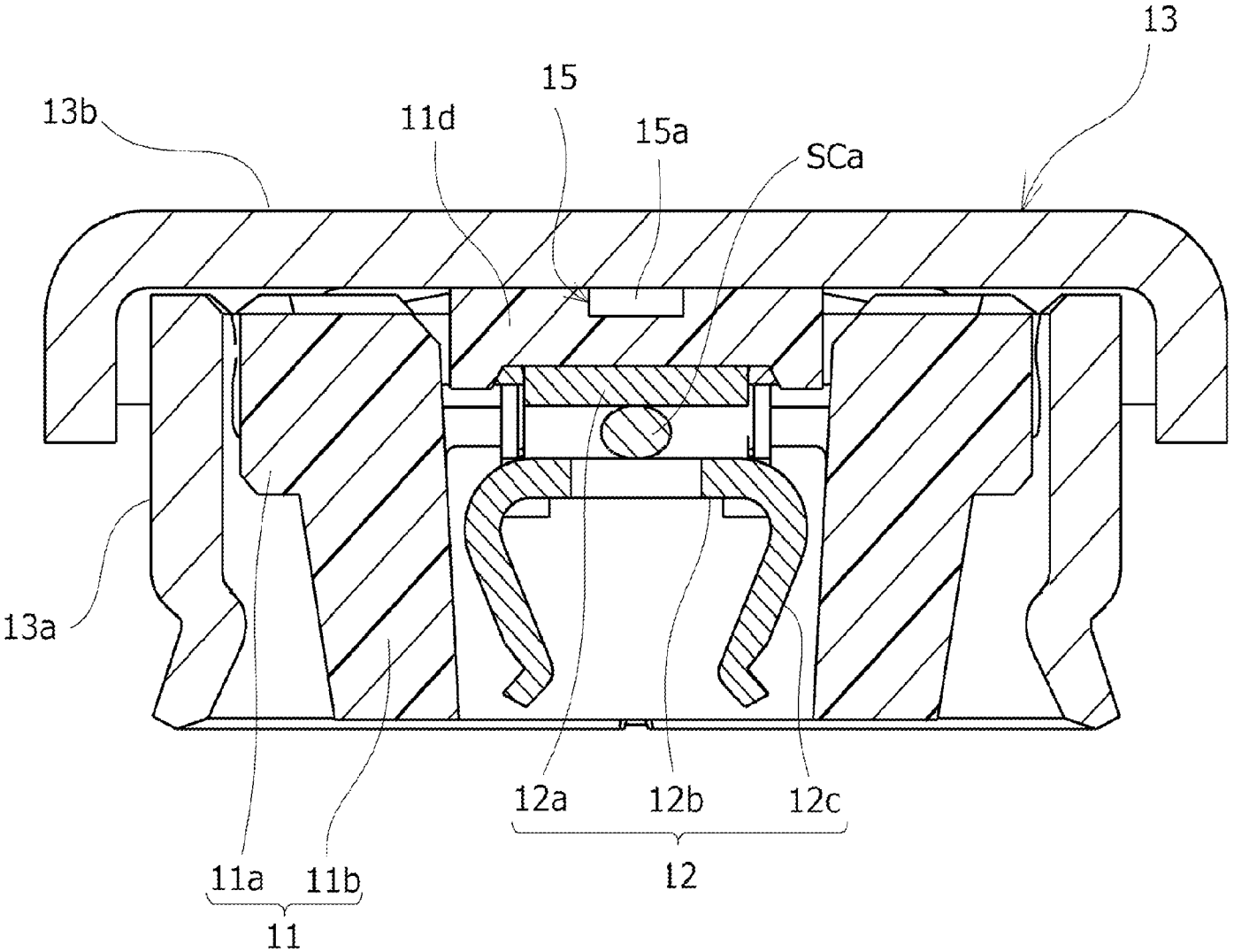
FIG. 25 is a transverse cross-sectional explanatory view of a coaxial electric connector (plug connector) in an eighth embodiment of the present invention corresponding to FIG. 4.
Figure 26:
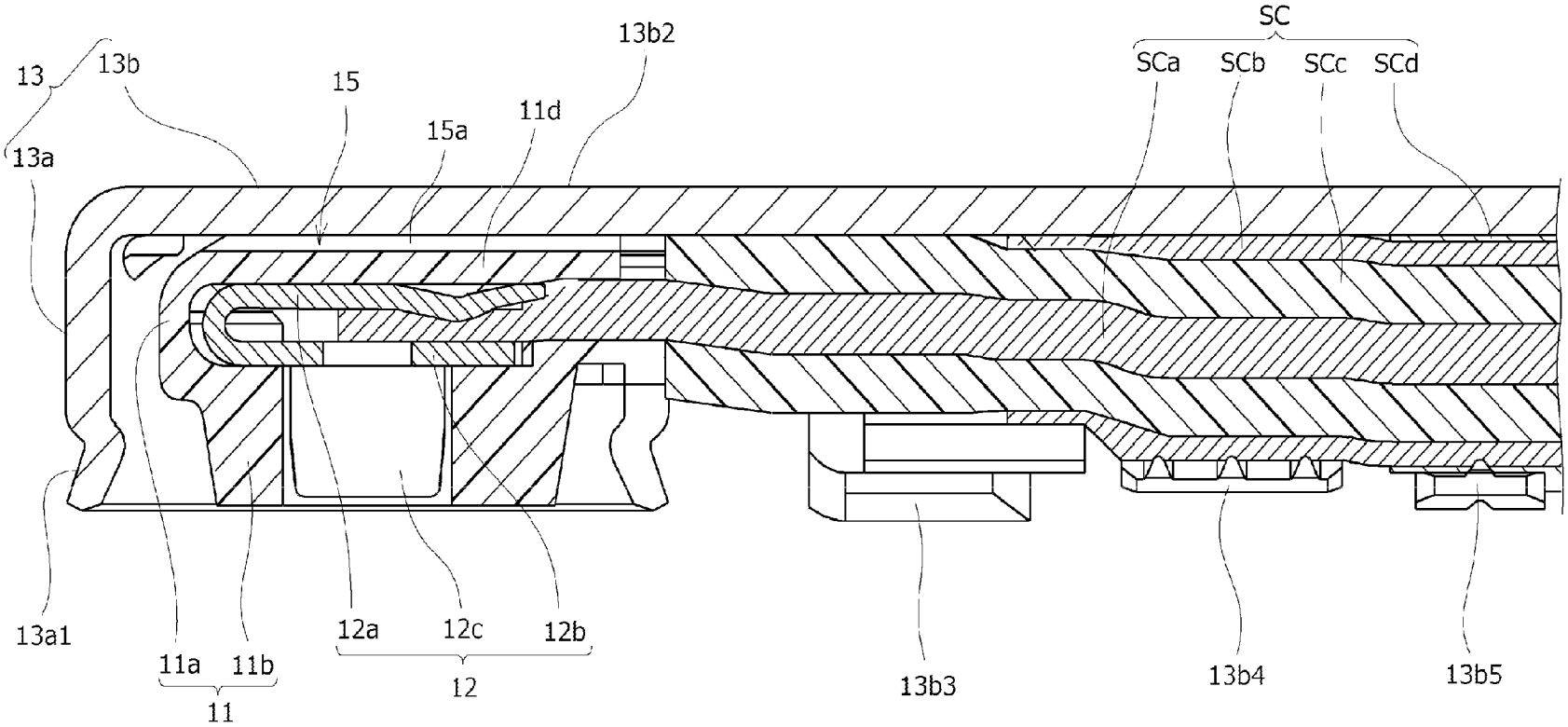
FIG. 26 is the vertical cross-sectional explanatory view of a coaxial electric connector (plug connector) in the eighth embodiment of the present invention.
Figure 27:
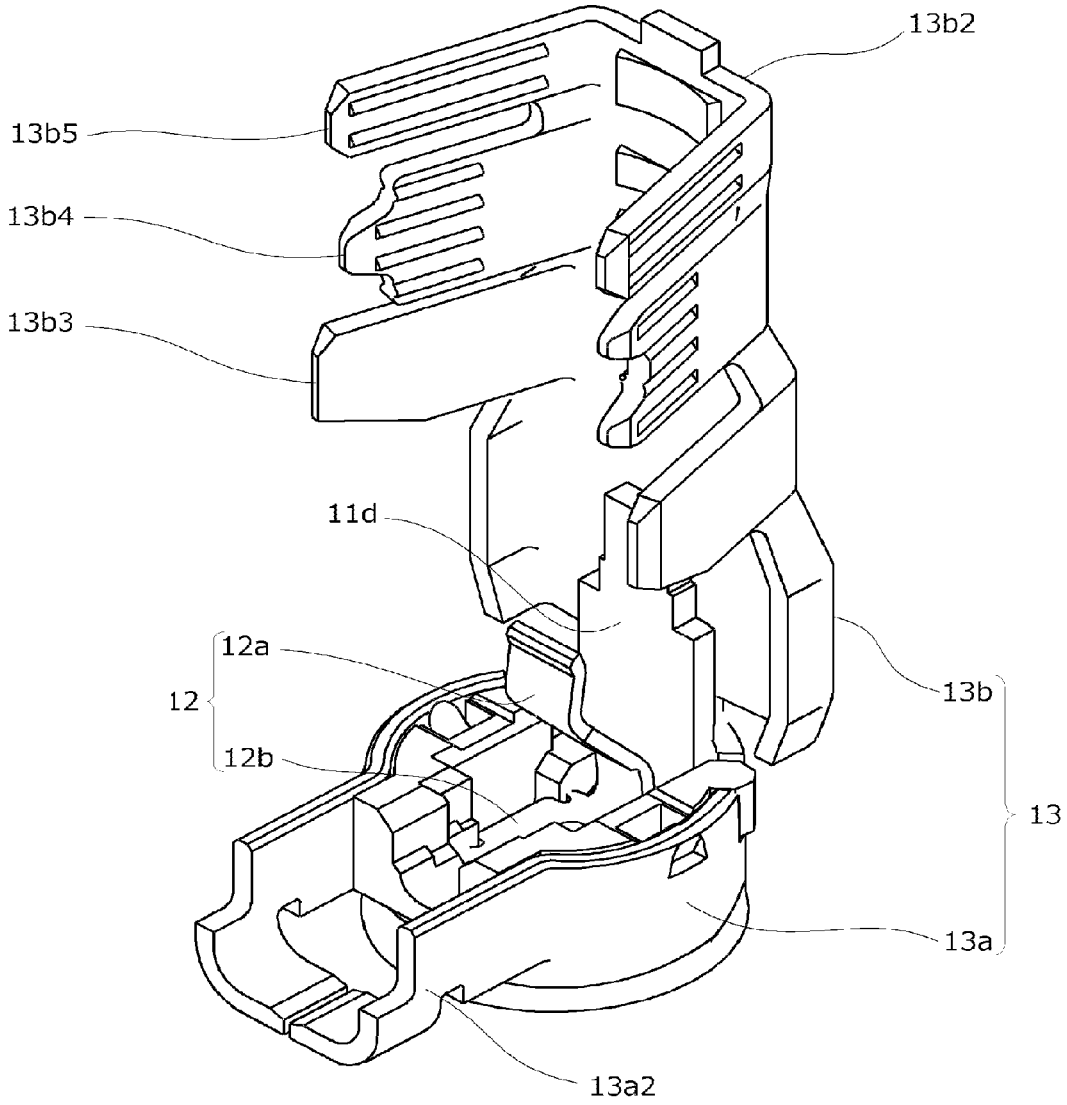
FIG. 27 is an external-appearance explanatory perspective view showing an initial open state (cable uncoupled state) of the coaxial electric connector (plug connector) in the eighth embodiment of the present invention.
Figure 28:
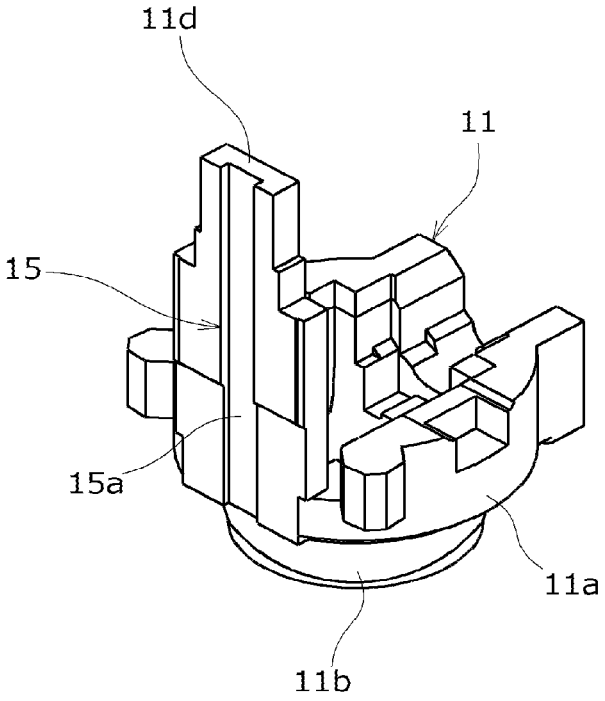
FIG. 28 is an external-appearance explanatory perspective view showing an initial open state (cable uncoupled state) of an insulating housing used in the coaxial electric connector (plug connector) in the eighth embodiment of the present invention.
Figure 29:
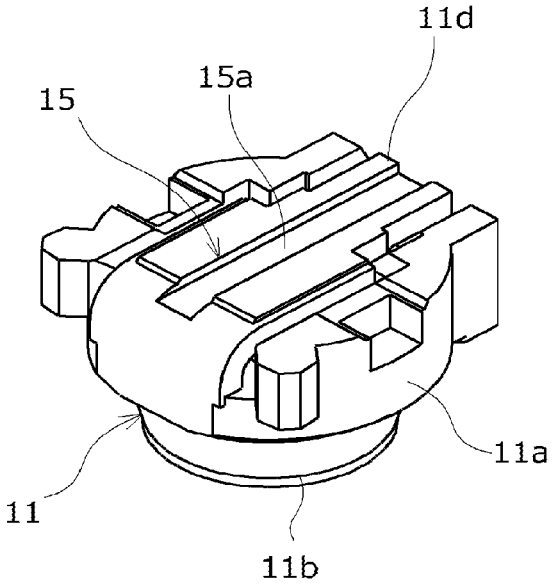
FIG. 29 is an external-appearance explanatory perspective view showing a closed state (cable coupled state) of the insulating housing used in the coaxial electric connector (plug connector) shown in FIG. 28.

Furthermore, in a seventh embodiment according to FIG. 23 and FIG. 24 in which the same constituent members as those of the above described embodiments are denoted by the same reference signs, a recessed groove-shaped part 14*c* similar to that of the third embodiment is provided on the cover inner surface of the shell cover part 13*b*1, and an integrated drop preventing part 14*h* extended in the groove-width direction is provided in the recessed groove-shaped part 14*c*. The drop preventing part 14*h* is also formed so as to have a surface continued from the cover inner surface of the shell cover part 13*b*. Since the surface of the insulative pressing plate 11*d* is received by the drop preventing part 14*h*, the insulative pressing plate 11*d* is reliably prevented from entering the interior of the recessed groove-shaped part 14*c*, and the void part 14 is reliably formed by the recessed groove-shaped part 14*c*.

According to the above described embodiments, by forming the drop preventing part in the partial region in the periphery of the void part 14 consisting of the recessed groove(s), the insulative pressing plate 11*d* is reliably prevented from entering the interior of the recessed groove-shaped part 14*c*, and, regarding the shape of the void part, depending on the type of the connector, a characteristic impedance value suitable therefor can be easily and appropriately matched.

Furthermore, in an eighth embodiment according to FIG. 25 to FIG. 29 in which the same constituent members as those of the above described embodiments are denoted by the same reference signs, a recessed groove-shaped part 15*a* constituting a void part 15 is provided on the insulative pressing plate 11*d*. The recessed groove-shaped part 15*a* is formed so as to be extended along the cable-shaped signal transmission medium SC from the coupled part of the cable placing part 12*b* and the tongue-shaped part 12*a* of the internal conductor contact 12 to the exposed part of the dielectric body SCc of the cable-shaped signal transmission medium SC. Also in such an embodiment, working/effects similar to those of the above described embodiments are exerted.

Figure 30:
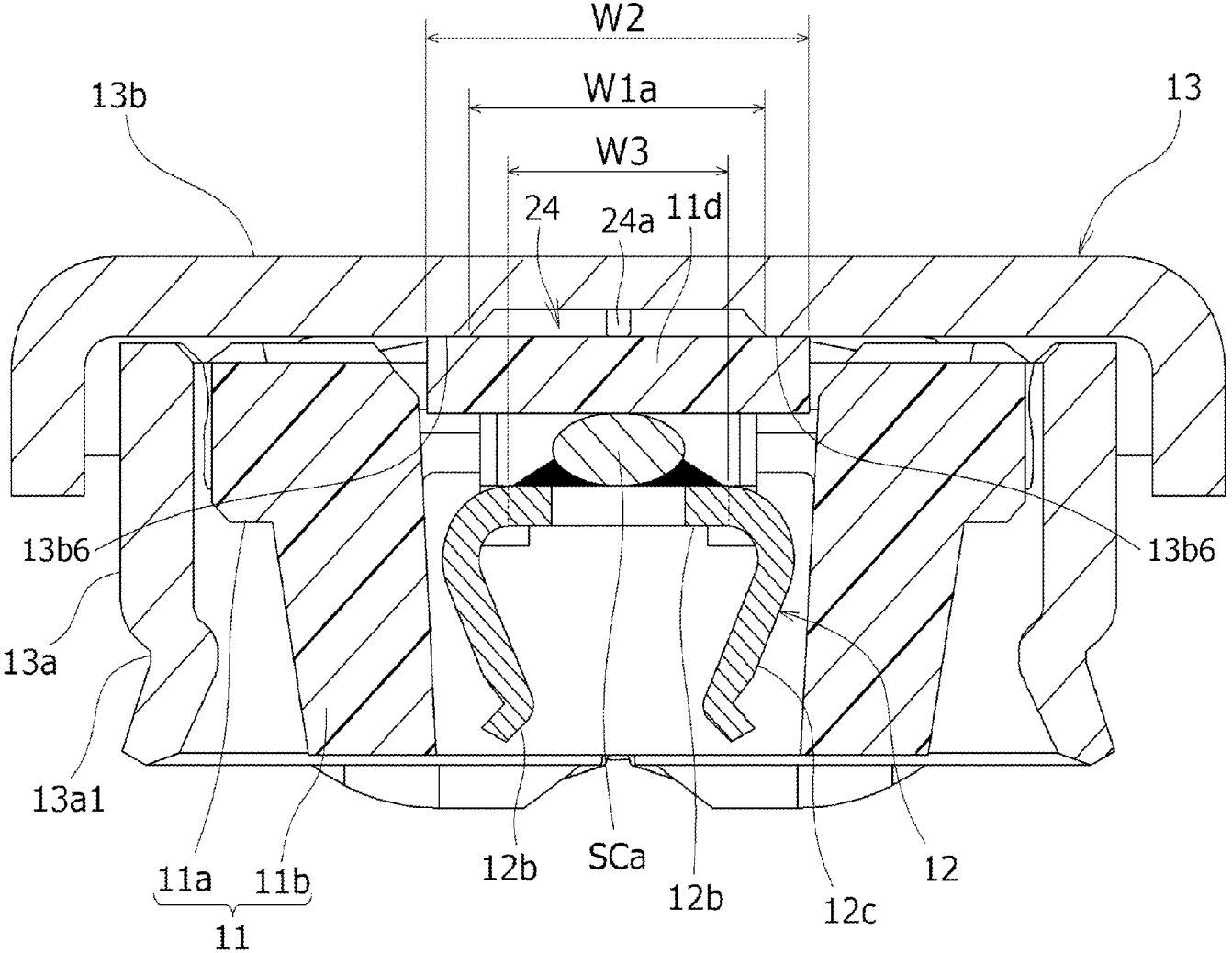
FIG. 30 is a transverse cross-sectional explanatory view showing the structure of a coaxial electric connector (plug connector) in a ninth embodiment of the present invention corresponding to FIG. 4.

On the other hand, in a ninth embodiment according to FIG. 30 in which the same constituent members as those of the above described embodiments are denoted by the same reference signs, the present invention is applied to a coaxial electric connector in which the cable center conductor (signal line) SCa of the thin coaxial cable SC is soldered in a state in which the cable center conductor is placed on the lower beam part (cable placing part) 12*b* of the electrically-conductive contact 12 from the upper side. More specifically, the electrically-conductive contact 12 in the present embodiment only has the lower beam part 12*b* and is not provided with an upper beam part (tongue-shaped part) like the above described embodiments.

In an electrical connection region in which the cable center conductor SCa of the thin coaxial cable SC is electrically connected to the lower beam part (cable placing part) 12*b* of the electrically-conductive contact 12, the groove width W1a of a void part 24 is set to be larger than the plate width W3 of the lower beam part 12*b* of the electrically-conductive contact 12 (W1a>W3).

The groove width W1a of the void part 24 in the electrical connection region is formed so as to be smaller than the plate width W2 of the insulative pressing plate 11*d* (W1a<W2), and the cover inner surface of the cover part 13*b* positioned in groove-width-direction both sides of the void part 24 is formed into drop preventing parts 13*b*6, which abut the upper surface of the insulative pressing plate 11*d*. The drop preventing parts 13*b*6 is brought into a multi-layer relation with the insulative pressing plate 11*d* when the drop preventing parts abut the upper surface of the insulative pressing plate 11*d*. The insulative pressing plate 11*d* does not enter the interior of the recessed groove-shaped part constituting the void part 24. Therefore, the void part 24 is reliably formed.

Furthermore, a drop preventing part 24*a* which regulates drop of the insulative pressing plate 11*d* into the interior of the void part 24 is provided at a groove-width-direction center part of the recessed groove-shaped part constituting the void part 24 of the present embodiment. The drop preventing part 24*a* in the present embodiment is formed by a rib-shaped member which is formed so as to rise from the bottom surface of the recessed groove-shaped part constituting the void part 24. When a top part of the drop preventing part 24*a* consisting of the rib-shaped member abuts the surface of the insulative pressing plate 11*d*, deformation, etc of a plate-width-direction center part of the insulative pressing plate 11*d* are prevented, the insulative pressing plate 11*d* does not enter the interior of the void part 24, and the void part 24 is reliably formed.

When the recessed groove-shaped part on the cover inner surface of the shell cover part is formed in accordance with presence/absence of the upper beam part (tongue-shaped part) of the electrically-conductive contact 12 like that of the ninth embodiment like this or above described first embodiment, the characteristic impedance value suitable for each case can be easily and appropriately matched.

Hereinabove, the invention accomplished by the present inventor has been explained in detail based on the embodiments. However, the present embodiments are not limited to the above described embodiments, and it goes without saying that various modifications can be made within a range not departing from the gist thereof.

For example, in the above described embodiments, the void part is formed by the recessed groove-shaped part(s). However, in formation of the void part, other means such as forming the part between a pair of projections as a void part can be employed as a matter of course.

In the above described embodiments, the void part consisting of the recessed groove-shaped part is formed by reducing the thickness of the shell cover part. However, instead of reducing the thickness of the shell cover part, the void part may be formed by curving and deforming part of the shell cover part into a projecting shape by, for example, pressing.

Furthermore, in the above described embodiments, the present invention is applied to the electric connector of a vertical mating type, but can be similarly applied also to an electric connector of a horizontal mating type.

The present invention is not limited to a connector for a single-core thin coaxial cable like that of the above described embodiments, but can be similarly applied, for example, also to a connector for a coaxial cable disposed in a multipolar shape and also to an electric connector of a type in which a plurality of coaxial cables and insulating cables are mixed.

As described above, the present embodiments can be widely applied to various electric connectors used in various electric devices.

What is claimed is:

1. An electric connector having an insulating housing to be coupled to a terminal part of a cable-shaped signal transmission medium;

an external conductor shell consisting of an approximately hollow cylindrical member attached so as to cover part of an external surface of the insulating housing, an internal conductor contact attached to an inner region of the insulating housing;

a shell cover part for opening/closing a cylindrical opening of the external conductor shell which is openably/closably coupled to the cylindrical opening of the external conductor shell;

an insulative pressing plate provided so as to be integrally opened/closed with the shell cover part in the insulating housing extending along a cover inner surface of the shell cover part;

wherein, a predetermined region of the cover inner surface of the shell cover part is configured to be disposed so as to be opposed to the insulative pressing plate when the shell cover part is closed so as to cover the cylindrical opening of the external conductor shell; the electrical connector comprising, a void part provided in a region in which the cover inner surface of the shell cover part and the insulative pressing plate are opposed to each other, the void part formed by separating at least one of the cover inner surface of the shell cover part and the insulative pressing plate from the other.

2. The electric connector according to claim 1, wherein the cable-shaped signal transmission medium is formed by a coaxial cable having a cable center conductor connected to the internal conductor contact and a cable shield conductor disposed in an outer peripheral side of the cable center conductor via a dielectric body; and the internal conductor contact is provided with a cable placing part on which the cable center conductor of the cable-shaped signal transmission medium is placed and a tongue-shaped part extended from a part coupled to the cable placing part and pushed against the insulative pressing plate.

3. The electric connector according to claim 2, wherein the void part consisting of the recessed groove is formed so as to be extended along the cable-shaped signal transmission medium from the coupled part of the cable placing part and the tongue-shaped part of the internal conductor contact to an exposed part of the dielectric body of the cable-shaped signal transmission medium.

4. The electric connector according to claim 1, wherein the void part is formed by a recessed groove formed on at least one of the cover inner surface of the shell cover part and the insulative pressing plate so as to be extended along the cable-shaped signal transmission medium.

5. The electric connector according to claim 4, wherein, in a partial region of a periphery of the void part consisting of the recessed groove, a drop preventing part for regulating drop of the insulative pressing plate into the void part is provided.

6. The electric connector according to claim 4, wherein the void part consisting of the recessed groove is formed by reducing the thickness of the shell cover part.

* * * * *